US005169746A

United States Patent [19]

Sasaki

[11] Patent Number: 5,169,746

[45] Date of Patent: Dec. 8, 1992

[54] SILVER HALIDE COLOR PHOTOGRAPHIC PHOTOSENSITIVE MATERIAL

[75] Inventor: Noboru Sasaki, Minami-ashigara, Japan

[73] Assignee: Fuji Photo Film Co., Ltd., Kanagawa, Japan

[21] Appl. No.: 632,534

[22] Filed: Dec. 24, 1990

[30] Foreign Application Priority Data

Dec. 27, 1989 [JP] Japan ..... 1-339801

[51] Int. Cl.[5] ..... G03C 1/46; G03C 7/18; G03C 7/305

[52] U.S. Cl. ..... 430/504; 430/503; 430/505; 430/957; 430/956; 430/362

[58] Field of Search ..... 430/503, 504, 505, 508, 430/957, 956, 362

[56] References Cited

U.S. PATENT DOCUMENTS

| | | | |
|---|---|---|---|
| 4,948,716 | 8/1990 | Mihayashi et al. | 430/505 |
| 5,024,925 | 6/1991 | Deguchi | 430/379 |
| 5,037,728 | 8/1991 | Shiba et al. | 430/505 |

FOREIGN PATENT DOCUMENTS 62-160449 7/1987 Japan .

*Primary Examiner*—Charles L. Bowers, Jr.
*Assistant Examiner*—Mark F. Huff
*Attorney, Agent, or Firm*—Birch, Stewart, Kolasch & Birch

[57] ABSTRACT

A silver halide color photographic photo-sensitive material comprises a support, and a layer arrangement formed on the support. The layer arrangement includes a red-sensitive silver halide emulsion layer containing a color coupler capable of forming cyan dye upon reacting with an oxidation product of a developing agent, a green-sensitive silver halide emulsion layer containing a color coupler capable of forming magenta dye upon reacting with the oxidation product of the developing agent, and a blue-sensitive silver halide emulsion layer containing a color coupler capable of forming yellow dye upon reacting with the oxidation product of the developing agent. The red-sensitive layer has a sensitivity at 650 nm of 50% or less of its maximum sensitivity, and contains substantially no magenta-colored couplers.

10 Claims, No Drawings

SILVER HALIDE COLOR PHOTOGRAPHIC PHOTOSENSITIVE MATERIAL

BACKGROUND OF THE INVENTION

1. Field of the Invention

The present invention relates to a silver halide color photographic photosensitive material and, more particularly, to a color photographic photosensitive material which can reproduce various hues and lightnesses of red and green, all faithful to those of the original images, and which can therefore form images with faithful shadings and rich in stereoscopic effect.

2. Description of the Related Art

As is known in the art, interlayer effect or interimage effect can be utilized in order to improve the color reproducibility of color photographic photosensitive material. In the case of a color negative photosensitive material, the color emission of a red-sensitive layer in white exposure can more be inhibited than that in red exposure by applying development-inhibiting effect from a green-sensitive layer to the red-sensitive layer. In the case of color negative paper, the interlayer effect achieves cyan-dye formation in a density higher in the case where the paper is red-exposed than in the case where the paper is gray-exposed. It is because the gradation is balanced such that gray will be reproduced on the color print when the paper is exposed to white light. As a result of this, red of higher saturation can be reproduced on the print, with the cyan dye formation greatly inhibited. For the same reason, green of high saturation can be reproduced on the print by applying development-inhibiting effect from the red-sensitive layer to the green-sensitive layer.

Various methods are known which work to promote the interlayer effect. One of them is to make use of the iodine ions released from the silver halide emulsion during development. In the method, a layer containing much silver iodide is used as layer for providing interlayer effect, whereas a layer containing less silver iodide is used as a layer for receiving the interlayer effect. Another known method of promoting the interlayer effect is disclosed in JP-A-50-2537 ("JP-A" means Published Unexamined Japanese Patent Application). In this method, a coupler is added to the layer providing the interlayer effect, said coupler releasing a development inhibitor when it reacts, in a paraphenylenediamine-based color developing solution, with the oxidation product of the developing agent. Still another known method of promoting interlayer effect is the so-called "automatic masking method," in which a colored coupler is added to an uncolored coupler, thereby masking the unnecessary absorption of the dye in the uncolored coupler. More specifically, the colored coupler can be added in an amount more than required to mask the unnecessary dye absorption, thus accomplishing the same effect as the interlayer effect.

SUMMARY OF THE INVENTION

An object of the present invention is to provide a silver halide color photographic photosensitive material which can reproduce both green and red of various hues and lightnesses faithfully.

According to the invention, there is provided a silver halide color photographic photo-sensitive material, comprising: a support; and a layer arrangement formed on said support and comprising: a red-sensitive silver halide emulsion layer containing a color coupler capable of forming cyan dye upon reacting with an oxidation product of a developing agent, a green-sensitive silver halide emulsion layer containing a color coupler capable of forming magenta dye upon reacting with the oxidation product of the developing agent, and a blue-sensitive silver halide emulsion layer containing a color coupler capable of forming yellow dye upon reacting with the oxidation product of the developing agent; said red-sensitive layer having a sensitivity at 650 nm of 50% or less of its maximum sensitivity, and containing substantially no magenta-colored couplers.

DETAILED DESCRIPTION OF THE PREFERRED EMBODIMENTS

In order to increase chromatics of green, the inventor prepared a color negative film by applying a magenta-colored cyan coupler, which has been commonly applied to color negative film since 1960s, to a red-sensitive silver-halide emulsion layer, and also adding a DIR compound to the red-sensitive silver-halide emulsion layer, thus promoting the interlayer effect applied from the red-sensitive layer to the green-sensitive layer. The inventor took pictures of green objects, and printed the photographed images on a color paper. The inventor examined the printed images, finding that the images were poor in shading and, hence, lacking stereoscopic effect. Then, the inventor studied the reasons for the poor shading. It was found that the shading had greatly depended on the way of applying the interlayer effect.

To be more specific, the present inventor found that a color reproduction rich in green shading and excellent in stereoscopic effect can be obtained if the red-sensitive and green-sensitive emulsion layers are so designed that the masking from the red-sensitive layer to the green-sensitive layer is insufficient, i.e., under-masking, when the green-sensitive layer does not sense the light and the red-sensitive layer senses the light, and that the degree of masking from the red-sensitive layer to the green-sensitive layer becomes larger, from normal-masking to finally over-masking, as the green-sensitive layer senses more and more light.

Conversely, when a colored coupler was added to the red-sensitive layer in an excessive amount, without adding a substance, such as a DIR coupler, which promotes the interlayer effect by development inhibition, thereto and the red-sensitive layer masks the green-sensitive layer to an excess, magenta dye can hardly enter the shadow portions of green on the print, inevitably lessening the shading effect. In this case, the red-sensitive emulsion layer performs an over-masking on the green-sensitive emulsion layer, regardless of the light-sensing level of the green-sensitive layer.

Further, the inventor hereof repeated experiments in order to find the best possible method of applying the interlayer effect to the red-sensitive emulsion layer so that red shading is reproduced faithfully to those of an object with the increase in lightness of red. Finally, the inventor found that, unlike in the fidelity of reproduced green shading, the fidelity of reproduced red shading greatly depends on the spectral sensitivity distribution of the red-sensitive silver-halide emulsion layer. In other words, the reproduced red shading can be sufficiently faithful to those of the object, provided that the wavelength which provides the maximum sensitivity of the red-sensitive emulsion layer falls within a range of 595 to 645 nm, which is the range for the ordinary photographic color photosensitive material, and that the sensitivity thereof at 650 nm is 50% or less of the maximum sensitivity.

As a result of the experiments the present inventor has finally found that a silver halide photographic color photosensitive material which can reproduce green and red, which are important as colors of objects of photography, with high stereoscopic effect can be established. More specifically, the present invention is directed to a photosensitive material comprising a support, and a layer arrangement formed on the support and including a red-sensitive silver halide emulsion layer containing a color coupler which forms cyan dye upon reaction with the oxidation product of a developing agent, green-sensitive silver halide emulsion layer containing a color coupler which forms magenta dye upon reaction with the oxidation product of the developing agent, and a blue-sensitive silver halide emulsion layer containing a color coupler which forms yellow dye upon reaction with the oxidation product of the developing agent, the red-sensitive emulsion layer has a sensitivity at 650 nm of 50% or less of its maximum sensitivity, and the red-sensitive emulsion layer contains substantially no magenta colored coupler.

The spectral sensitivity distribution of the silver halide color photographic photosensitive material must be obtained in order to determine a wavelength of light rays to which the red-sensitive layer exhibits its maximum sensitivity, and also a sensitivity at a specified wavelength. The spectral sensitivity distribution can be obtained by means of an equi-energy spectral sensitometer.

The maximum sensitivity wavelength of the red-sensitive emulsion used in the present invention falls within a range of 595 to 645 nm. Otherwise, the silver halide color photographic photosensitive material cannot reproduce color hues as defined by the standard color chip such as the color chart published by Macbeth Co., Ltd.

Preferably, the sensitivity at 650 nm of the red-sensitive emulsion is 30% or less of its maximum sensitivity.

The words "substantially no magenta-colored coupler" means that the red-sensitive layer provides undermasking to the green-sensitive layer, when it is exposed singly. In other words, it means that when only the red-sensitive layer is exposed and developed, and the density is measured using a green filter, a negative image is observed. The gradient of the negative image, i.e., the ratio of the density to the logarithm of light exposure applied to the red-sensitive layer is 0.05 or more.

It is desirable that the red-sensitive layer contains 10 mol % or less, preferably 5 mol % or less, of magenta-colored coupler per mol of the un-colored cyan dye forming coupler. Nonetheless, the content of the magenta-colored coupler can be more than 10 mol % if the red-sensitive layer which mainly develops cyan contains, for some reason, a magenta-developing coupler such as an uncolored magenta coupler, an yellow-colored magenta coupler, or a magenta DIR coupler. Whether the content of the magenta-colored coupler exceeds 10 mol % or not, it would suffice if the resultant negative image has the gradient of 0.05 or more, as described above.

The green-sensitive emulsion layer used in the present invention can have either a single-layer structure of a multi-layer structure. To intensify the effect of the invention, the green-sensitive layer should better be development-inhibited by any other layer of the color photographic photosensitive material. In order to intensify the interlayer effect from the red-sensitive layer, in proportion to the photosensing level of the green-sensitive layer, it is advisable to increase the silver/coupler ratio of the high-speed green sensitive sub-layer which develops color mainly when the photosensing level is low, thereby suppressing the developed color-density reduction resulting from the development-inhibiting substance used, and to decrease the silver/coupler ratio of the lower-speed green-sensitive sub-layer, thereby promoting the developed color-density reduction. Also, to intensify the interlayer effect the red-sensitive layer imparts to the green-sensitive layer, it is advisable that a coupler whose graininess may easily be lost be used in combination with silver halide in the high-speed sub-layer, or, for example, the high-speed sub-layer be formed of a monodispersed silver halide emulsion. Equally advisable is that the high-speed layer contain a two-equivalent coupler which is likely to lose its graininess.

For similar reasons, it is recommendable to add a low-speed coupler and a high-speed coupler to the high-speed and low-speed green-sensitive sub-layers, respectively.

Moreover, the silver halide emulsion color photographic photosensitive material according to the invention can attain better color photographic properties by modifying the layer which imparts the interlayer effect. For instance, to enhance the interlayer effect of the red-sensitive layer in proportion to the photosensing level of the green-sensitive layer, at least one sublayer of the red-sensitive layer or a layer adjacent thereto contains a compound which cleaves upon reacting with the oxidation product of a color developing agent to form a cleaved product, which in turn cleaves the development inhibitor upon reacting with another molecule of the oxidation product of the color developing agent. The interlayer effect of the red-sensitive layer can be enhanced by this method, probably for the following reason.

After the first-stage reaction of the commonly used DIR compound, that is, after the reaction with the oxidation product of the color developing agent, which has been generated in the red-sensitive emulsion layer, the DIR compound cleaves the development inhibitor or the compound which releases the development inhibitor upon lapse of a predetermined time. By contrast, the compound used in the invention does not release the development inhibitor or the compound which releases the inhibitor upon lapse of the predetermined time, unless the compound cleaved in the first-stage reaction further reacts with another molecule of the oxidation product of the color development agent. Hence, the compound cleaved in the first-stage reaction diffuses into the green-sensitive silver-halide emulsion layer. The higher the concentration of the oxidation product of the color developing agent, the more development inhibitor the diffused compound will release, or the more compound, which releases the inhibitor upon lapse of the predetermined time, the diffused compound will release, thus inhibiting the development. In other words, the higher the photosensing level of the green-sensitive layer, the more prominent is the interlayer effect which the red-sensitive layer imparts to the green-sensitive layer, and the excessive is the masking which the red-sensitive layer performs on the green-sensitive layer.

In order to enhance the interlayer effect from the red-sensitive layer to the green-sensitive layer, it would also be effective if at least one sub-layer of the red-sensitive layer or a layer adjacent thereto contains a compound which is cleaved upon reacting with the oxidation product of the color developing agent to form a cleaved product, which in turn cleaves the development inhibitor after a predetermined timing.

It has been further found that the silver halide color photographic photosensitive material of the invention hardly turns green when exposed to the white light emitted from a fluorescent lamp of the commonly used type.

The reason why the material hardly turns green remains unclear. Nevertheless, it is assumed that the magenta-colored cyan coupler absorbs light rays whose wavelengths overlaps the distribution of short-wave spectral sensitivity of the red-sensitive silver-halide emulsion layer, inevitably degrading the sensitivity of the red-sensitive emulsion layer, and, by removing or suppressing the magenta-colored cyan coupler, the spectral sensitivity distribution of the red-sensitive layer changes. Probably, this change in spectral sensitivity distribution synergistically works together with the interlayer effect applied on the green-sensitive layer, whereby the material hardly turns green when exposed to white light.

Detailed description will now be made of the compound which is cleaved upon reacting with the oxidation product of the color developing agent to form a cleaved product, which in turn cleaves the development inhibitor upon reacting with another molecule of the oxidation product of the color development agent. This compound, which releases a development inhibitor and will be hereinafter referred to as "diffusible development inhibitor releasing compound," can be represented by any one of the following formulas:

| | |
|---|---|
| A-TIME-$Z_2$ | [VI] |
| A-$Z_1$ | [VII] |
| B-$Z_1$ | [VIII] |
| A (or B)-P-$Z_2$ | [IX] |

In formulas [VI] to [IX], A is a coupling component which can react with the oxidation product of the color developing agent to release -TIME-$Z_2$ group or -P-$Z_2$ group, B is a redox portion which first undergoes a redox reaction with the oxidation product of the color developing agent and then undergoes alkali hydrolysis, releasing $Z_1$ or P-$Z_2$, and TIME is a timing group. Also in formulas [VI] to [IX], $Z_1$ is a diffusible development inhibitor, -P-$Z_2$ is a group which, after being released from A or B, generates a development inhibitor upon reacting with the oxidation product of the developing agent. Further, $Z_2$ is a diffusible development inhibitor having diffusibility or little diffusibility. A-TIME-$Z_2$ is a diffusible DIR compound if -TIME-$Z_2$ is diffusible. A(or B)-P-$Z_2$ is a diffusible DIR compound if -P-$Z_2$ is diffusible.

The development inhibitor represented by either $Z_1$ or $Z_2$ includes those disclosed in Research Disclosure, Vol. 176, No. 17643 (December, 1978). Preferably, it is mercaptotetrazole, selenotetrazole, mercaptobenzothiazole, selenobenzothiazole, mercapto-benzooxazole, selenobenzooxazole, mercaptobenzimidazole, selenobenzimidazole, benzotriazole, mercaptotriazole, mercaptooxadiazole, mercaptothiadiazole, or a derivative of any of these compounds.

The preferable diffusible development inhibitors are represented by the following formulas:

(Z-1)

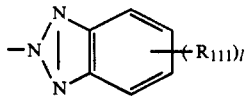

(Z-2)

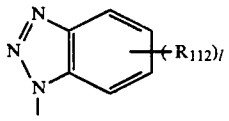

(Z-3)

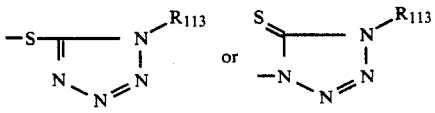

(Z-4)

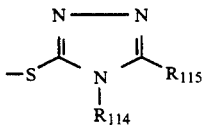

(Z-5)

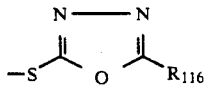

(Z-6)

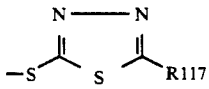

(Z-7)

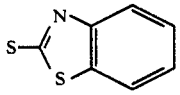

(Z-8)

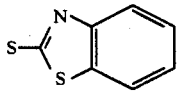

(Z-9)

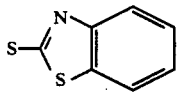

In formulas [Z-1] and [Z-2], $R_{111}$ and $R_{112}$ are an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbomoyl group, an N,N-dialkylcarbamoyl group, a nitro group, an amino group, an N-arylcarbamoyloxy group, a sulfamoyl group, a sulfonamide group, an N-alkylcarbamoyloxy group, an ureido group, a hydroxy group, an alkoxycarbonylamino group, an aryloxy group, an alkylthio group, an arylthio group, an anilino group, an aryl group, an imide group, a heterocyclic group, a cyano group, an alkylsulfonyl group, or an aryloxycarbonylamino group.

In formulas [Z-1] and [Z-2], l is either 1 or 2. If l is 2, $R_{111}$ and $R_{112}$ can be either identical or different. The total number of the carbon atoms contained in l number of $R_{111}$ or $R_{112}$ ranges from 0 to 20.

In formulas [Z-3], [Z-4], [Z-5], and [Z-6], $R_{113}$, $R_{114}$, $R_{115}$, $R_{116}$, and $R_{117}$ represent an alkyl group, an aryl group, or a heterocyclic group.

If $R_{111}$ to $R_{117}$ are alkyl groups, they can be substituted ones, unsubstituted ones, chain ones, or cyclic ones. Examples of the substitutent groups are a halogen atom, a nitro group, a cyano group, an aryl group, an alkoxy group, an aryloxy group, an alkoxycorbony group, an aryloxycarbony group, a sulfamoyl group, a carbamoyl group, a hydroxy group, an alkanesulfonyl group, an arylsulfonyl group, an alkylthio group, and an arylthio group.

If $R_{111}$ to $R_{117}$ are aryl groups, they can be substituted. The examples of the substituents are an alkyl group, an alkenyl group, an alkoxy group, an alkoxycarbonyl group, a halogen atom, a nitro group, an amino group, a sulfamoyl group, a hydroxy group, a carbamoyl group, an aryloxycarbonylamino group, an alkoxycarbonylamino group, an acylamino group, a cyano group, and an ureido group.

If $R_{111}$ to $R_{117}$ are heterocyclic groups, they are 5-membered or 6-membered single or fused rings which contain, as a hetero atom, nitrogen, oxygen or sulfur atom. The examples of the heterocyclic groups are a pyridyl group, a quinolyl group, a furyl group, benzothazolyl group, an oxazolyl group, an imidazolyl group, a thiazolyl group, a triazolyl group, a benzotriazolyl group, an imide group, and an oxazine group. These heterocyclic groups can be substituted by those groups specified as substitutents for the aryl group.

In formulas [Z-1] and [Z-2], $R_{111}$ or $R_{112}$ contains 1 to 20 carton atoms, preferably 7 to 20 carbon atoms.

In formulas [Z-3], [Z-4], [Z-5], and [Z-6], $R_{113}$ to $R_{117}$ each contain 1 to 20 carbon atoms in total, preferably 4 to 20 carbon atoms in total.

Preferred as a development inhibitor in the present invention is a compound which releases an development inhibitor upon reacting with the oxide of the developing agent, said inhibitor performing its function when it diffuses from one layer in which it is contained to another layer.

The coupler component represented by A in formulas VI, VII, and IX is one which forms a dye, or forms substantially no dyes. Examples of the dye-forming couplers include acylacetoanilides, malondiesters, malondiamides, benzoylmethanes, pyrazolones, pyrazotriazoles, pyrazobenzimidazoles, indazolones, phenols, and naphthols. The examples of the coupler which form virtually no dyes include acetophenones, indanones, and oxazolones.

Preferable coupler components are those represented by the following formulas [X] to [XIII]:

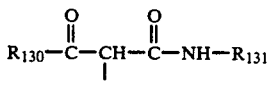

Formula [X]

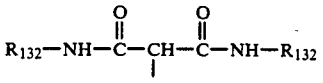

Formula [XI]

-continued

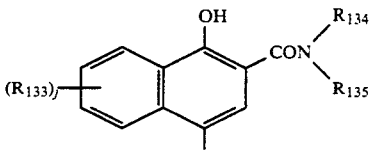

Formula [XII]

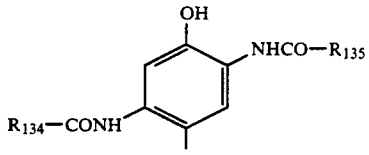

Formula [XIII]

In formulas [X], [XI], [XII], and [XIII], $R_{130}$ is an aliphatic group, an aromatic group, an alkoxy group, or a heterocyclic group, and $R_{131}$ and $R_{132}$ are either an aromatic group or a heterocyclic group.

The aliphatic group represented by $R_{130}$ is preferably a substituted or unsubstituted chain or cyclic one, having 1 to 20 carbon atoms. Preferable examples of substituent groups on the alkyl group are an alkoxy group, an aryloxy group, and an acylamino group.

If $R_{130}$, $R_{131}$, or $R_{132}$ is an aromatic group, it is a phenyl group, a naphthyl group, or the like. Of these, a phenyl group is most useful. The phenyl group can have a substituent group which may be an alkyl group, an alkenyl group, an alcoxy group, an alkoxycarbonyl group, an alkylamide group, or the like, having 30 or less carbon atoms. The phenyl group, which is represented by $R_{130}$, $R_{131}$, or $R_{132}$ can be substituted by an alkyl group, an alkoxy group, a cyano group, or a halogen atom.

$R_{133}$ is a hydrogen atom, an alkyl group, a halogen atom, a carboamide group, a sulfonamide group or the like. The suffix "j" is an integer ranging from 1 to 5. $R_{134}$ and $R_{135}$ are hydrogen atoms, alkyl groups, or aryl groups. If they are aryl groups, they are preferably phenyl groups. The alkyl and aryl groups can have a substituent group, which may be a halogen atom, an alkoxyl group, an aryloxy group, a carboxyl group, or the like. $R_{134}$ and $R_{135}$ can either be identical or different.

Formula [VIII] represents a compound (hereinafter referred to as "DIR redox compound") which performs a redox reaction to the oxide of an aromatic primary amine developing agent and undergoes alkali hydrolysis, thus releasing a development inhibitor or a precursor thereof. In formula [VIII], B represents a redox portion. The DIR redox compound is identified more precisely by the following formula [XIV]:

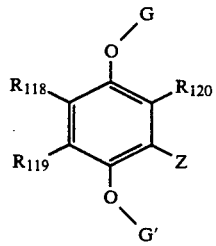

In formula [XIV], G and G' are hydrogen atoms or protective groups for phenolic hydroxyl groups, which can be removed during the photographing process. Typical examples of G and G' are a hydrogen atom, an acyl group, a sulfonyl group, an alkoxycarbonyl group, a carbamoyl group, and an oxalyl group.

In formula [XIV], $R_{118}$, $R_{119}$, and $R_{120}$ can be identical or different. Examples of these are a hydrogen atom, a halogen atom, an alkyl group, an aryl group, an alkoxy group, an aryloxy group, an alkylthio group, an arylthio group, a cyano group, an alkoxycarbonyl, carbamoyl group, a sulfamoyl group, a carboxyl group, a sulfo group, a sulfonyl group, an acyl group, a carbonamide group, a sulfonamide group, or a heterocyclic group.

$R_{118}$ and $R_{119}$ can combine together to form an aromatic ring or a non-aromatic ring. $R_{118}$ and G can also combine to form an aromatic ring or a non-aromatic ring. Also $R_{119}$ and G' can combine to form an aromatic ring or a non-aromatic ring. Further, $R_{120}$ and G can combine together to form an aromatic ring or a ,non-aromatic ring. Of $R_{118}$, $R_{119}$, and $R_{120}$, at least one contains an anti-diffusion group which has 10 to 20 carbon atoms.

In formula [XIV], too, Z represents a development inhibitor as described above.

The development inhibitor used in the present invention is preferably the one represented by formula [IX], where P is a group which becomes a redox group or a coupler after it has been cleaved from A or B.

The development inhibitor released upon reacting with the oxide of the developing agent can be a compound that diffuses from one layer in which it is contained into another layer, inhibiting the development.

The diffusible development inhibitor releasing compounds can be easily synthesized by known methods. These methods are disclosed in, for example, U.S. Pat. Nos. 3,227,554, 3,617,291, 3,933,500, 3,958,993, 4,149,886 and 4,234,678, JP-A-51-13239, JP-A-57-56837, British Patents 2,070,266 and 2,072,363, Research Disclosure No. 21228, December, 1981, JP-B-58-9942, JP-B-51-16141 ("JP-B" means Published Examined Japanese Patent Application), JP-A-52-90932, U.S. Pat. No. 4,248,926, JP-A-56-114946, JP-A-57-154234, JP-A-5898728, JP-A-58-209736, JP-A-58-209737, JP-A-58-209738, JP-A-58-209740, Japanese Patent Application 59-278853, JP-A-61-255342, and JP-A-62-24252.

Representative concrete examples of the diffusible development inhibitor releasing compounds used in the present invention are those identified by the following formulas. It should be noted that the compounds which can be used in the invention are not limited to these examples.

T-101

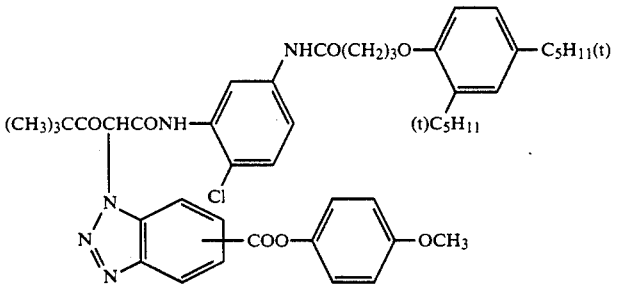

T-102

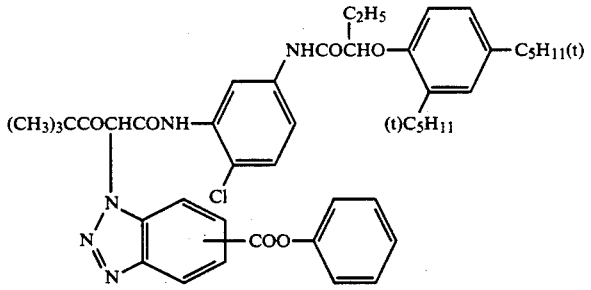

T-103

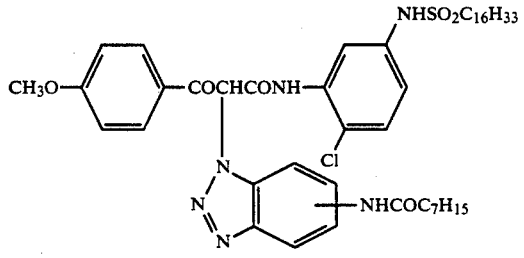

-continued
T-104
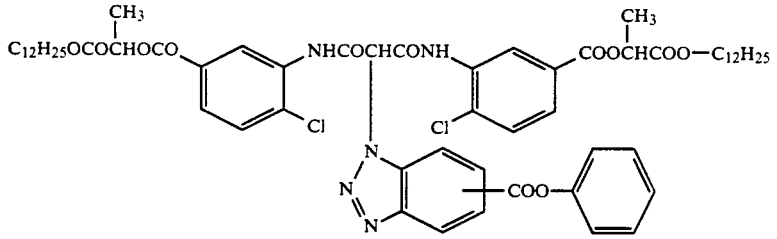
T-105
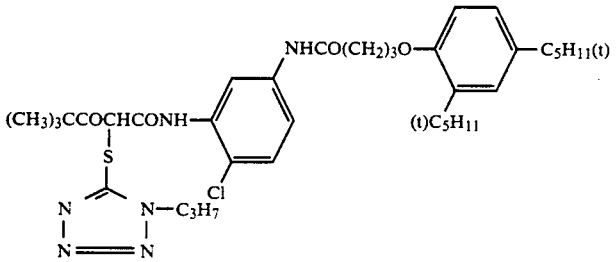
T-106
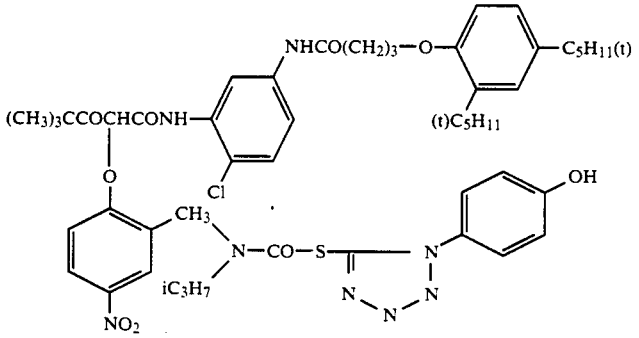
T-107
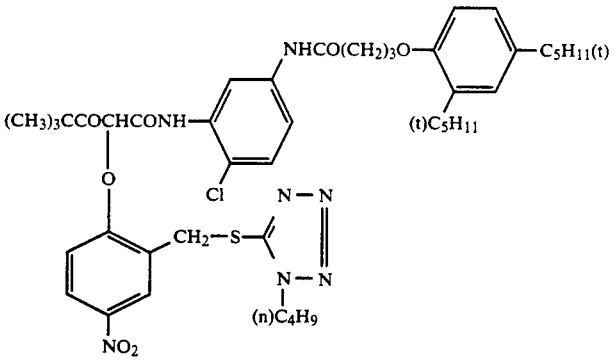
T-108
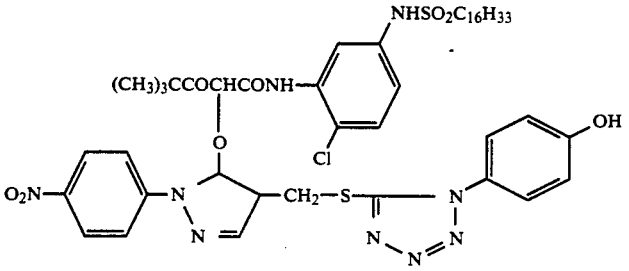

-continued
T-109
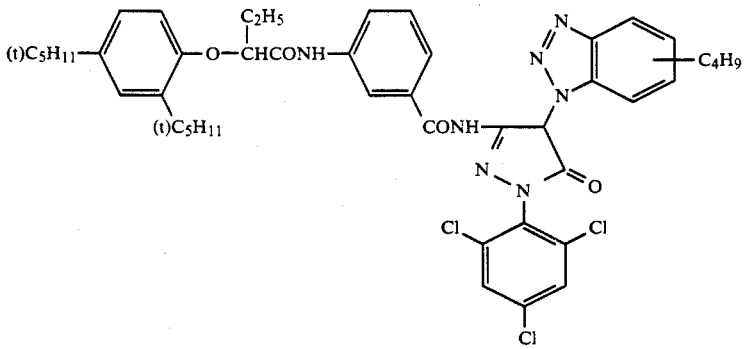
T-110
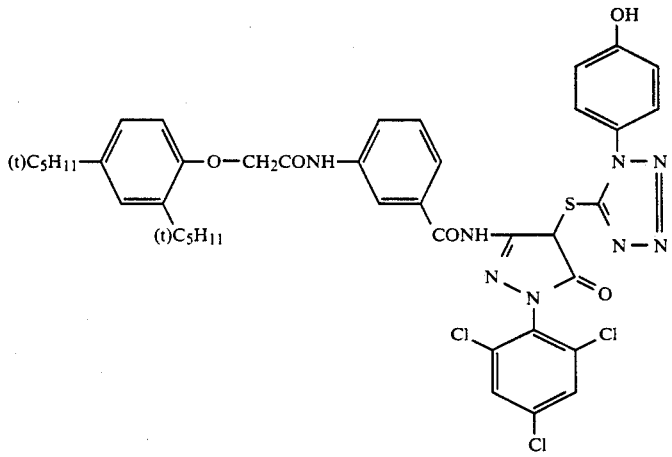
T-111
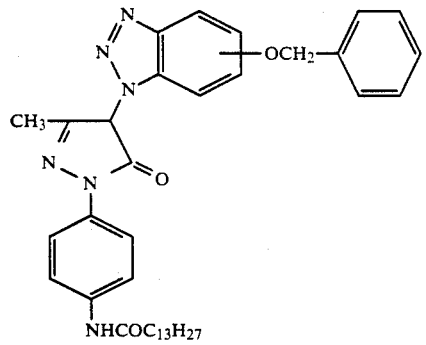
T-112
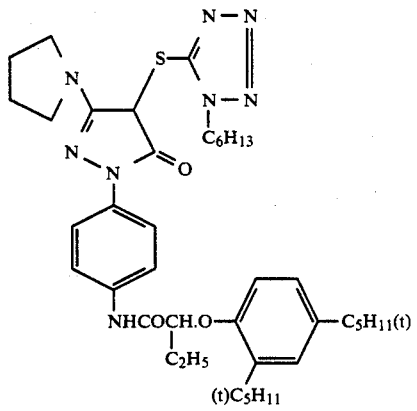

-continued
T-113
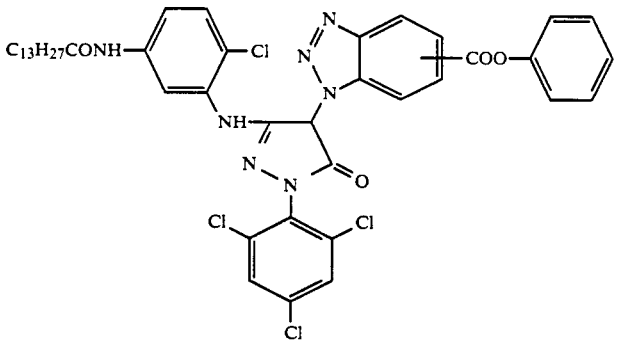
T-114
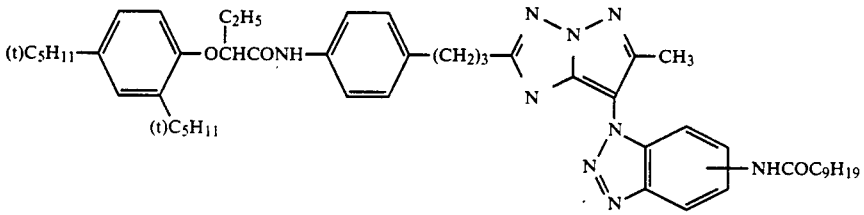
T-115
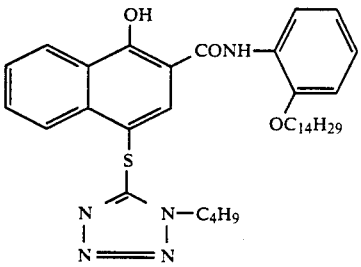
T-116
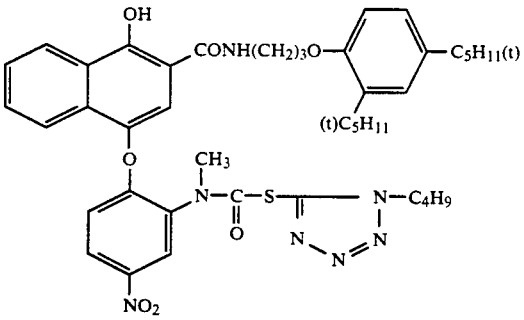
T-117
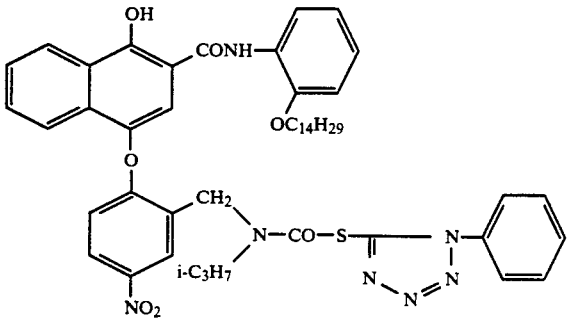

-continued
T-118
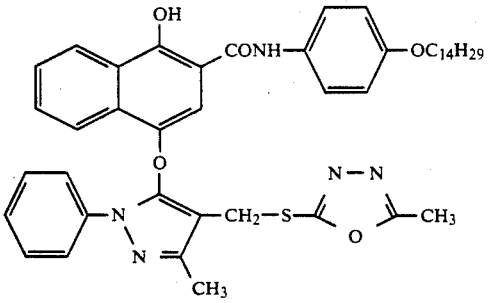
T-119
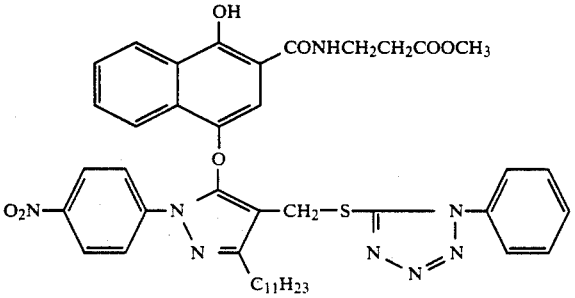
T-120
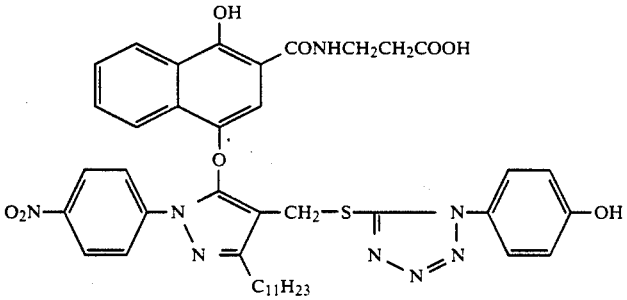
T-121
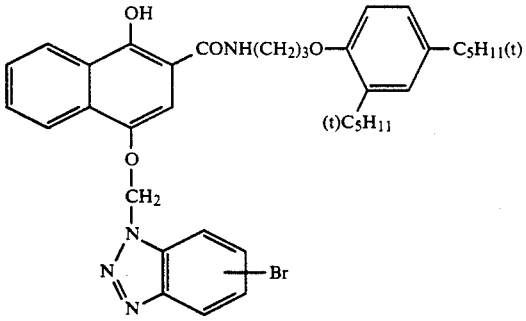
T-122
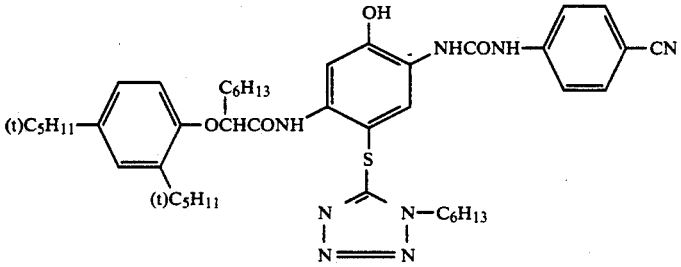

-continued
T-123
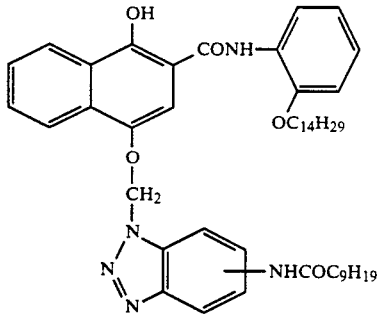
T-124
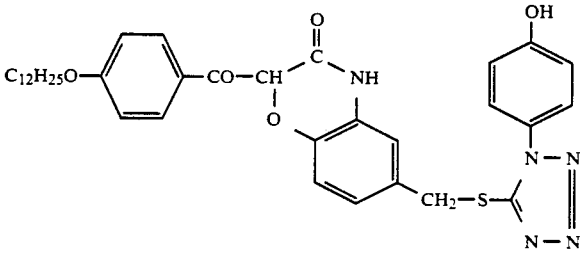
T-125
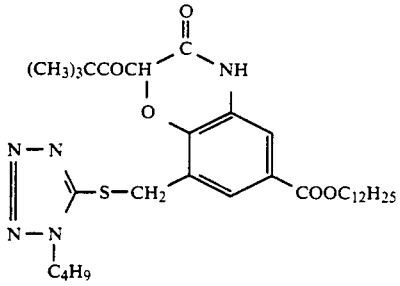
T-126
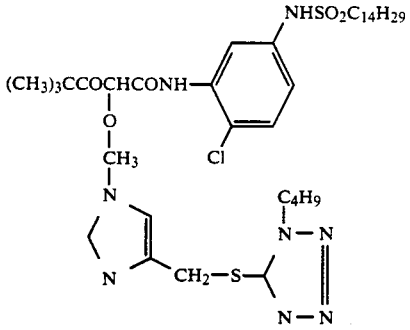
T-127
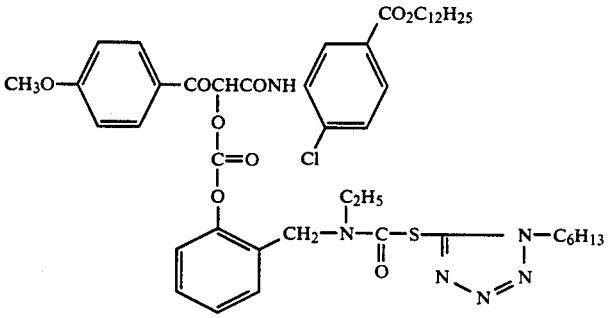

-continued
T-128
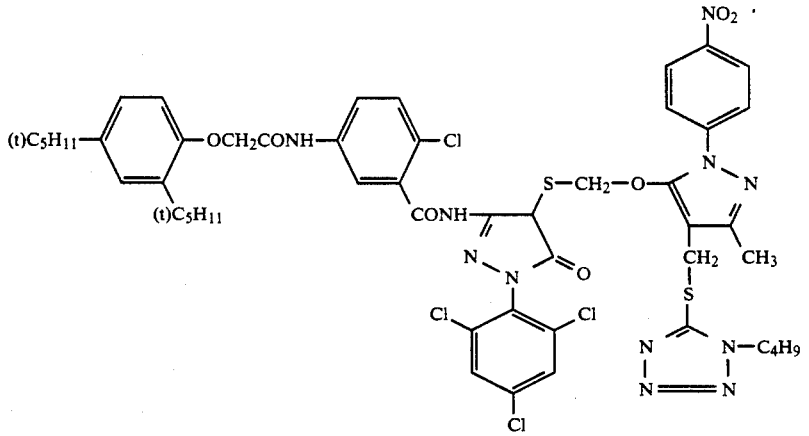
T-129
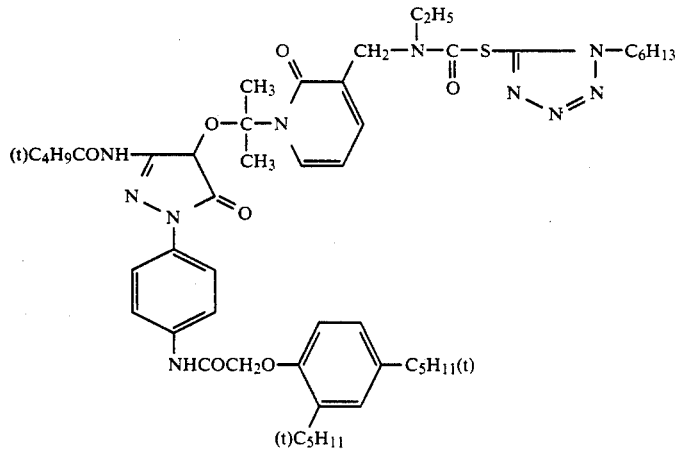
T-130
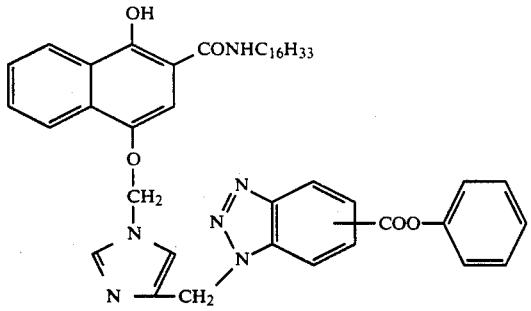
T-131
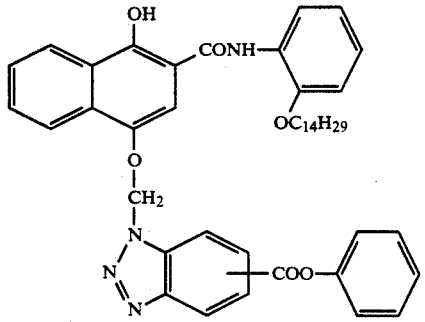

-continued
T-132
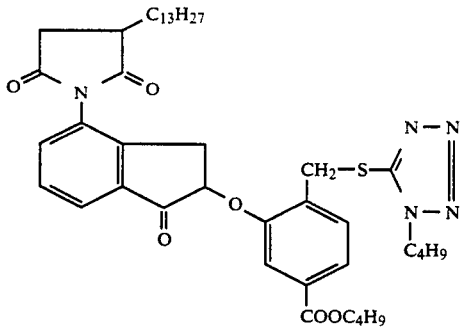
T-133
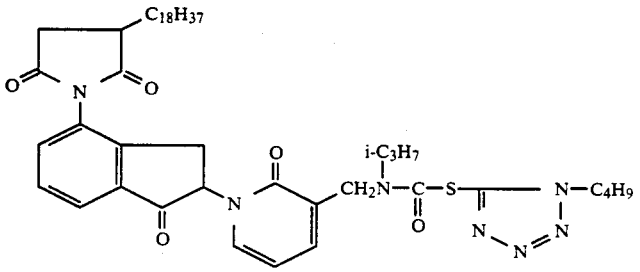
T-134
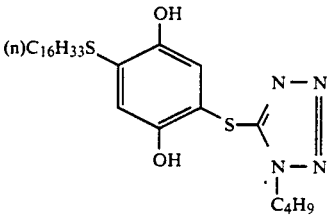
T-135
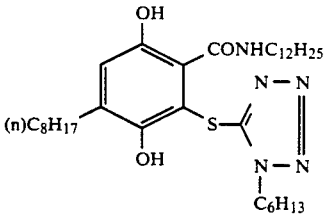
T-136
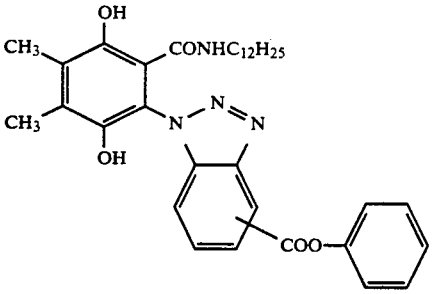
T-137
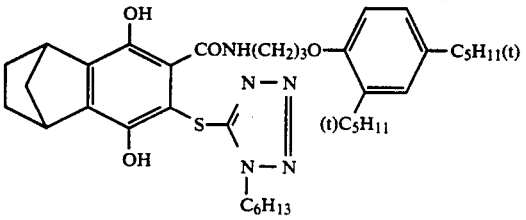

-continued
T-138
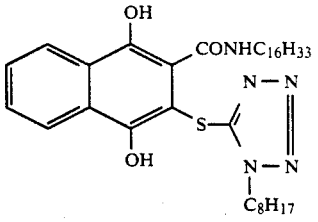
T-139
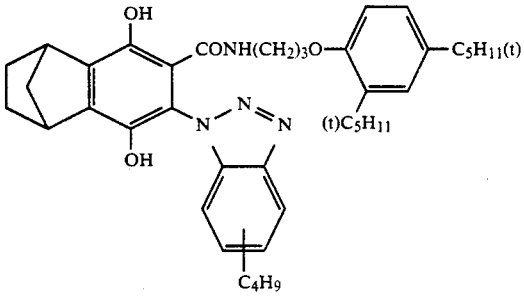
T-140
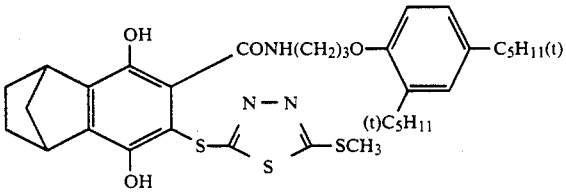
T-141
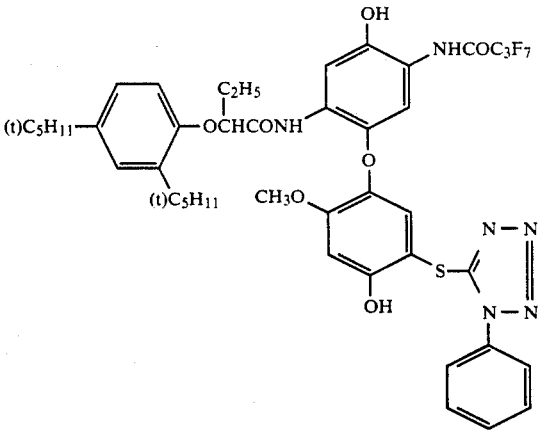
T-142
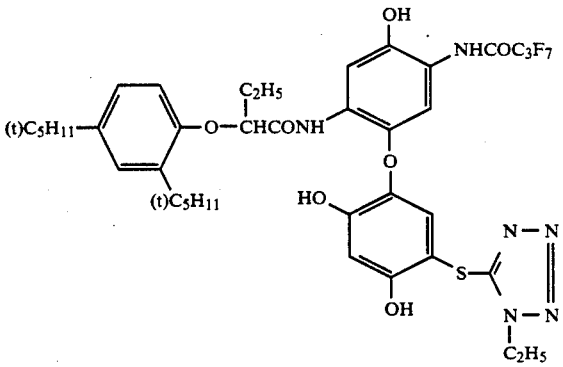

-continued
T-143
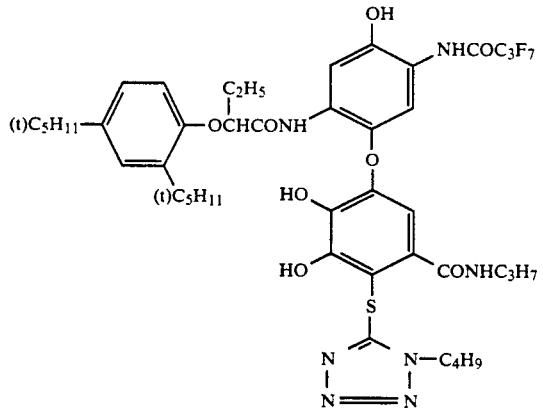
T-144
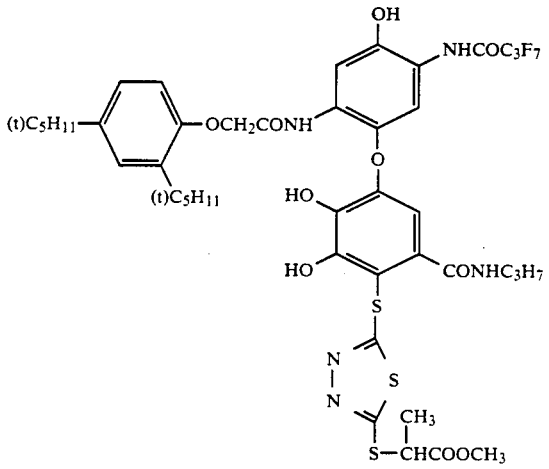
T-145
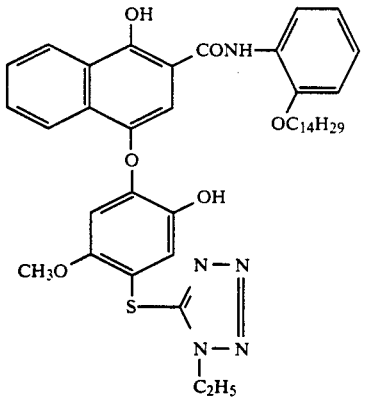
T-146
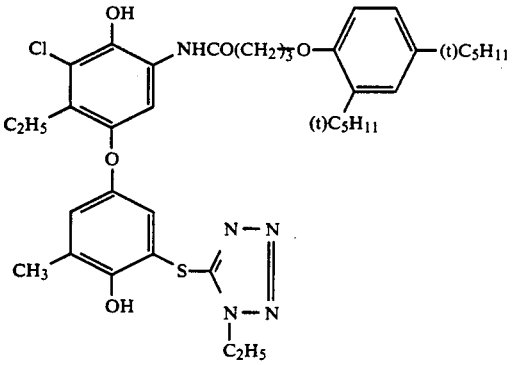

-continued
T-147
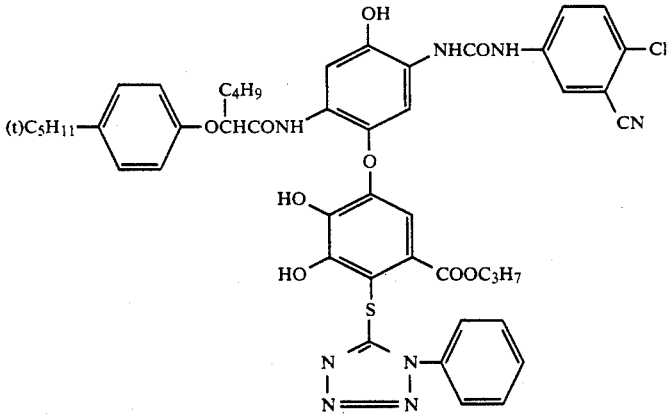
T-148
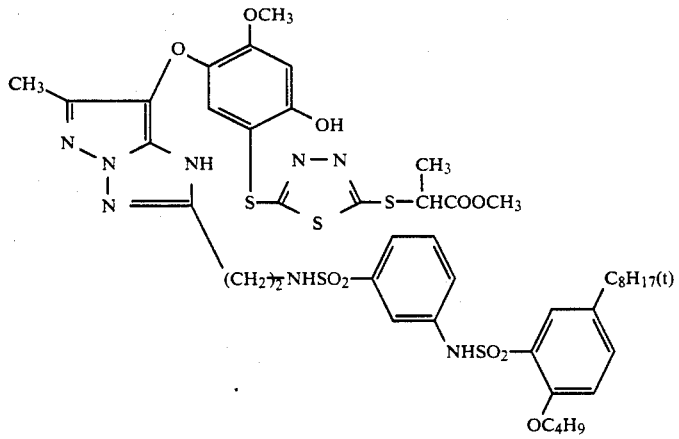
T-149
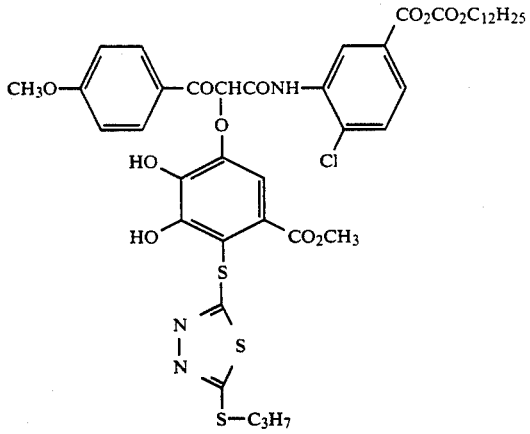
T-150
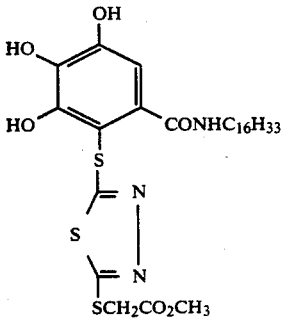

-continued

T-151

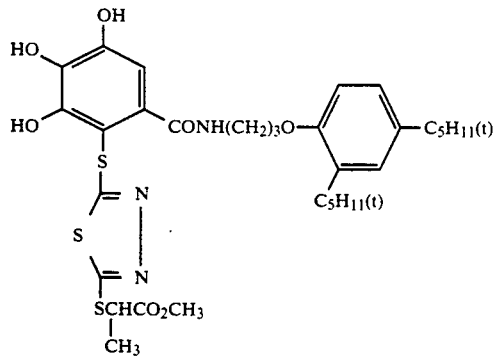

T-152

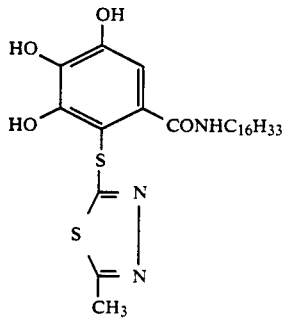

T-153

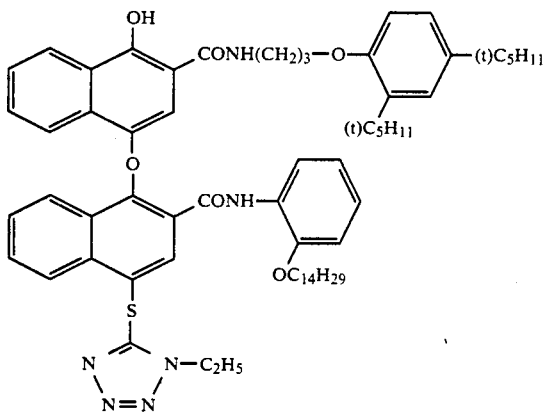

T-154

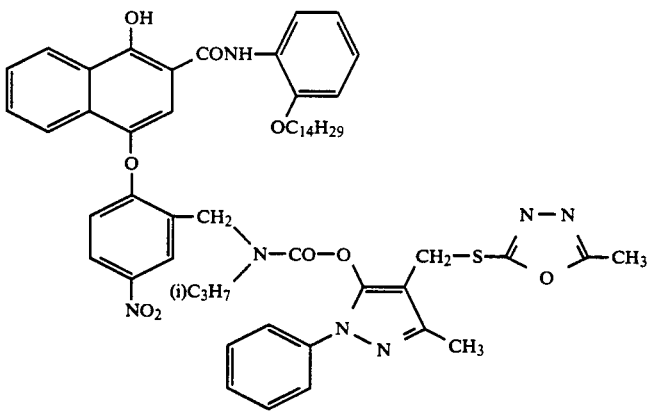

Any of the compounds [VI] to [IX] is contained in any layer of the photographic material, in an amount of 0.0001 to 0.1 mol per mol of silver, preferably 0.001 to 0.05 mol per mol of silver, more preferably 0.005 to 0.05 mol per mol of silver, if that layer contains a silver halide emulsion. If the layer contains no silver halide emulsions, the compound can be contained in the layer in an amount falling within said range per mol of silver which is contained in a layer adjacent to that layer.

The color photographic photosensitive material according to the invention comprises a support and at least one of each of three silver-halide emulsion layers formed on the support, which are blue-sensitive, green-sensitive, and red-sensitive, respectively. There is no limit to the number of silver-halide emulsion layers and non-photosensitive layers which constitute the photographic photosensitive material. A representative example of the material is one which comprises a support and at least one photosensitive layer formed of two or more silver-halide emulsion layers which have substantially the same color sensitivity but different photosensitivities or speeds. These emulsion layers are unit photosensitive layers each of which is sensitive to any of blue light, green light, and red light. Generally, in a multilayer color photographic photosensitive material, the unit photosensitive layers are arranged such that a red-sensitive emulsion layer, a green-sensitive emulsion layer, and a blue-sensitive layer are formed in this order from the side of the support. Nevertheless, the order in which the emulsion layers are arranged can be reversed in accordance with the use of the photographic photosensitive material. Further, a different photosensitive layer can be sandwiched between two emulsion layers of the same color sensitivity.

A non-photosensitive layer such as an interlayer can be interposed between any two silver-halide emulsion layers, and can be formed below the lowermost silver-halide emulsion photosensitive layer or on the uppermost silver-halide emulsion layer.

The interlayer can contain a coupler, a DIR compound, and the like, disclosed in JP-A-61-43748, JP-A-59-113438, JP-A-59-113440, JP-A-61-20037, and JP-A-61-20038. Further, it can contain a color-mixing inhibitor which is commonly used in color photographic photosensitive materials.

Preferably, a plurality of silver halide emulsion layers constituting the unit photosensitive layer comprises two sub-layers, i.e., a high-speed layer and a low-speed layer, as disclosed in, for example, West German Patent 1,121,470 and British Patent 923,045. Usually it is desirable that the low-speed layer be located closer to the support than the high-speed layer. A non-photosensitive layer can be interposed between the high-speed layer and low-speed layer. Conversely, the low-speed layer can be located farther from the support than the high-speed layer, as is disclosed in JP-A-57-112751, JP-A-62-200350, JP-A-62206541, and JP-A-62-206543.

An actual example of the color photographic photosensitive material comprises a low-speed blue-sensitive layer (BL), a high-speed blue-sensitive layer (BH), a high-speed green sensitive layer (GH), a low-speed green-sensitive layer (GL), a high-speed red-sensitive layer (RH), and a low-speed red-sensitive layer (RL), arranged in this order from top down to the support. Another example is of a BH/BL/GL/GH/RH/RL structure. Still another example is of a BH/BL/GH/GL/RL/RH structure.

Moreover, as is disclosed in JP-B-55-34932, the color photographic photosensitive material according to the invention can comprise a blue-sensitive layer, a GH layer, an RH layer, a GL layer, and an RL layer, arranged in this order from top down to the support. Further, as is disclosed in JP-A-56-25738 and JP-A-62-63936, the material can comprise a blue-sensitive layer, a GL layer, an RL layer, a GH layer, and an RH layer, arranged in this order from top down to the support.

Still further, as is disclosed in JP-B-49-15495, the color photographic photosensitive material of the invention can have three silver-halide emulsion layers, wherein the upper layer is made of a high-speed emulsion, the intermediate layer is made of a medium-speed emulsion, and the lower layer is made of a low-speed emulsion. Even in this three-layer structure, each color-sensitive layer can comprise three sub-layers, i.e., a medium-speed layer, a high-speed layer, and a low-speed layer, arranged in this order from top down to the support. Alternatively, each color-sensitive layer can comprise a high-speed layer, a low-speed layer, and a medium-speed layer, arranged in this order from top down to the support, or can comprise a low-speed layer, a medium-speed layer, and a high-speed layer.

Further, each of the color-sensitive layers of the photographic photosensitive material according to this invention can comprise four or more sub-layers. In this case, too, these sub-layers can be arranged in any of the alternative orders described above.

In order to improve the color reproducibility of the color photographic photosensitive material, it is advisable to arrange, near each main photosensitive layer BL, GL or RL, a donor layer (CL) which differs in spectral sensitivity distribution from the main photosensitive layers and which applies interlayer effect thereto. Such donor layers are disclosed in U.S. Pat. Nos. 4,663,271, 4,705,744 and 4,707,436, JP-A-62-160448, JP-A-63-89850.

As has been explained, various color sensitive layers can be used in various numbers, arranged in various orders, in accordance with the intended use of the silver halide color photographic photosensitive material.

The silver halide contained in any photographic emulsion layer is preferably silver iodobromide, silver iodochloride, or iodochlorobromide, which contains about 30 mol % or less of silver iodide. More preferable is silver iodobromide or silver iodochlorobromide, which contains about 2 mol % to about 25 mol % of silver iodide.

The silver halide grains in the emulsion can be regular crystals such as cubic grains, octahedral grains and tetradecahedral grains, irregular crystals such as spherical grains and tabular grains, or crystals having defects such as twinned crystal planes. Alternatively, the silver halide grains can be a mixture of these various crystals.

The silver halide grains can be fine ones having a size of about 0.2 microns or less, or large ones having a projected area diameter of up to about 10 microns. Further, the silver halide emulsions can either be monodispersed ones or polydispersed ones.

The silver halide photographic emulsion for use in the present invention can be prepared by using methods described in, for example, Research Disclosure (RD), No. 17643 (1978, December), PP. 22 and 23, "I. Emulsion Preparation and Types", and RD No. 18716 (1979, November), P. 648; P. Glafkides, "Chimie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, e.g., U.S. Pat. Nos. 3,574,628 and 3,655,394, and British Patent 1,413,748 are also preferable.

A tabular grain having an aspect ratio of about 5 or more can be used in the present invention. The tabular grain can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

A crystal structure may be uniform, may have different compositions of halogen in its inner and outer portions, or may be a layered structure. Alternatively, silver halides having different compositions may be bonded together by an epitaxial junction, or a compound other than a silver halide such as silver rhodanate or zinc oxide may be bonded to silver halide. In addition, a mixture of grains having various crystal shapes can be used.

The silver halide emulsion is normally subjected to physical ripening, chemical ripening, and spectral sensitization, and then used. Additives used in these steps are described in Research Disclosure Nos. 17643 and 18716, and they are summarized below.

It is desirable that fine grains of nonphotosensitive silver halide be used in the present invention. The non-photosensitive silver halide does not sense light when imagewise exposed to light to form a dye image, and is not substantially developed during the development process. Preferably, the grains of the non-photosensitive silver halide are not fogged beforehand.

The non-photosensitive silver halide fine grains contain 0 to 100 mol % of silver bromide. They can contain silver chloride and/or silver iodide, if necessary. Preferably, they contain 0.5 to 10 mol % of silver iodide.

The fine grains of the non-photosensitive silver halide have an average diameter (i.e., an average of circle equivalent, projected area diameter) of 0.01 to 0.5 μm, preferably 0.02 to 0.2 μm.

The non-photosensitive silver halide fine grains can be prepared by the same method as that of preparing ordinary photosensitive silver halide grains. The surface of each silver halide grain need not be sensitized optically. Nor do they need to be sensitized spectrally. It is desirable, however, that a known stabilizer such as a triazole compound, an azaindene compound, a benzothiazolium compound, a mercapto compound, or a zinc compound be added thereto, prior to the addition to a coating solution.

Conventional photographic additives for use in the present invention are also described in the above two RDs and listed in the Table below.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, supersensitizers | pages 23–24 | page 648, right column to page 649, right column |
| 4. Brighteners | page 24 | |
| 5. Antifoggants and stabilizers | pages 24–25 | page 649, right column |
| 6. Light Absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

-continued

In order to prevent degradation in photographic properties caused by formaldehyde gas, a compound which can react with and set formaldehyde described in U.S. Pat. Nos. 4,411,987 or 4,435,503 is preferably added to the photosensitive material.

In this invention, various color couplers can be used in the photosensitive material. Specific examples of these couplers are described the above-described Research Disclosure, No. 17643, VII-C to VII-G as patent references.

Preferred examples of a yellow coupler are described in, e.g., U.S. Pat. Nos. 3,933,501, 4,022,620, 4,326,024, 4,401,752, and 4,248,961 JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, those compounds described in, e.g., U.S. Pat. Nos. 4,310,619 and 4,351,897, EP 73,636, U.S. Pat. Nos. 3,061,432 and 3,725,067, Research Disclosure No. 24220 (June, 1984), JP-A-60-33552, Research Disclosure No. 24230 (June, 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO (PCT) 88/04795.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EPs 121,365A and 249,453A, U.S. Pat. Nos. 3,446,622, 4,333,999, 4,753,871, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,211, 4,367,282, 4,409,320, and 4,576,910, and British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting unnecessary absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368.

It is advisable to use a coupler disclosed in U.S. Pat. No. 4,774,181 which releases a fluorescent dye at the time of coupling, the fluorescent dye correcting unnecessary absorption of a colored dye, or a coupler disclosed in U.S. Pat. No. 4,777,120 which contains, as a releasing group, a dye-precursor group able to react with the developing agent to form a dye.

Couplers releasing a photographically useful residue group upon coupling can also be preferably used in the present invention. DIR couplers which releases a development inhibitor are preferably those described in the patents cited in the above-described Research Disclosure No. 17643, VII-F, JP-A-57-151944, JP-A-57-

154234, JP-A-60-184248, and JP-A-63-37346, and U.S. Pat. No. 4,248,962.

Preferable examples of a coupler imagewise releasing a nucleating agent or a development accelerator upon development are preferably those described in British Patents 2,097,140 and 2,131,188, and JP-A-59-157638 and JP-A-59-170840.

Examples of a coupler which can be used in the photosensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A; bleaching accelerator releasing couplers described in, e.g., RD. Nos. 11449 and 24241 and JP-A-61-201247; a ligand releasing coupler described in, e.g., U.S. Pat. No. 4,553,477; a leuco dye releasing coupler described in JP-A-63-75747; and a fluorescent dye releasing coupler disclosed in U.S. Pat. No. 4,774,181.

The couplers for use in this invention can be introduced in the photosensitive materials by various known dispersion methods.

Examples of a high-boiling solvent used in an oil-in-water dispersion method are described in, e.g., U.S. Pat. No. 2,322,027.

Examples of a high-boiling organic solvent to be used in the oil-in-water dispersion method and having a boiling point of 175° C. or more at normal pressure are phthalate esters (e.g., dibutylphthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-di-ethylpropyl) phthalate), phosphate or phosphonate esters (e.g., triphenyl phosphate, tricresyl phosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexyl benzoate, dodecyl benzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylate esters (e.g., bis(2-ethylhexyl)sebacate, dioctylazelate, glyceroltributyrate, isostearyllactate, and trioctylcitrate), aniline derivatives (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethyl acetate, and dimethylformamide.

Steps and effects of a latex dispersion method and examples of an impregnating latex are described in, e.g., U.S. Pat. No. 4,199,363 and west German Patent Application (OLS) Nos. 2,541,274 and 2,541,230.

Preferably, the color photographic photosensitive material according to the invention contains phenethyl alcohol, an antiseptic agent, or an antifungal agent. Examples of the antiseptic agent and the antifungal agent are: 1,2-benzisochiazoline-3-one, n-butyl-p-hydroxybenzoate, phenol, 4-chloro-3,5-dimethylphenol, 2-phenoxyethanol, 2-(4-thiazolyl) benzimidazole disclosed in JP-A-63-257747, JP-A-62-272248, JP-A-1-80941.

The present invention can be applied to various color photosensitive materials. Examples of the material are a color negative film for a general purpose or a movie, a color reversal film for a slide or a television, color paper, a color positive film, and color reversal paper.

Examples of a support suitable for use in this invention are described in the above-mentioned RD. No. 17643, page 28 and ibid., No. 18716, page 647, right column to page 648, left column.

The hydrophilic colloid layers in the color photographic photosensitive material according to the invention preferably have a total thickness of 28 μm or less, more preferably 23 μm or less, most preferably 16 μm or less. It is preferred that the hydrophilic colloid layers has a swelling speed $T_{\frac{1}{2}}$ of 30 seconds or less, preferably 20 seconds or less. The thickness of the colloid layers is one measured after these layers had been left to stand for two days at 25° C. at relative humidity of 55%. The swelling speed $T_{\frac{1}{2}}$ can be measured by the techniques known in the art, by means of, for example, a swellometer of the type which A. Green et al. describe in Photographic Science and Engineering, Vol. 19, No. 2, pp. 124–129. The swelling speed $T_{\frac{1}{2}}$ is the period of time which a colloid layer requires to swell to half the saturated thickness, i.e., 90% of the maximum swollen thickness when it is immersed in a color developing liquid at 30° C. for 3 minutes and 15 seconds.

The swelling speed $T_{\frac{1}{2}}$ can be adjusted by adding a proper amount of a hardening agent to gelatin which is used as a binder, or by changing the conditions under which each colloid layer is allowed to age after it has been coated. It is desirable that each hydrophilic colloid layer be swollen to a swelling ratio of 150 to 400%, said swelling ratio calculated as follows:

$$(Tmax-T)/T$$

where T is the thickness of the colloid layer mentioned above, and Tmax is the maximum swollen thickness the layer can have when treated under the above-mentioned conditions.

The color photographic photosensitive materials of the present invention can be developed by the ordinary processes as described, for example, in the above-described Research Disclosure, No. 17643, pages 28 and 29 and ibid., No. 18716, page 651, left to right columns.

A color developer used in developing of the photosensitive material of the present invention is an aqueous alkaline solution mainly consisting of, preferably, an aromatic primary amine-based color developing agent. As the color developing agent, although an aminophenol compound is effective, a p-phenylenediamine compound is preferably used. Typical examples of the p-phenylenediamine compound are 3-methyl-4-amino-N,N-diethylaniline, 3-methyl-4-amino-Nethyl-N-β-hydroxyethylaniline, 3-methyl-4-amino-N-ethyl-N-β-methanesulfonamidoethylaniline, 3-methyl-4-amino-N-ethyl-β-methoxyehtylaniline, and sulfates, hydrochlorides and p-toluenesulfonates thereof. Of these, the most preferable is a sulfate salt of 3-methyl-4-amino-N-ethyl-N-β-hydroxyethylaniline. These compounds can be used in a combination of two or more thereof in accordance with applications.

In general, the color developer contains a pH buffering agent such as carbonate salts, borate salts or phosphate salts of an alkali metal, and a development restrainer or antifoggant such as bromides, iodides, benzimidazoles, benzothiazoles or mercapto compounds. If necessary, the color developer may also contain a preservative such as hydroxylamine, diethylhydroxylamine, a hydrazine sulfite, a phenylsemicarbazide, triethanolamine, a catechol sulfonic acid or a triethylenediamine(1,4-diazabicyclo[2,2,2]octane); an organic solvent such as ethyleneglycol or diethyleneglycol; a development accelerator such as benzylalcohol, polyethyleneglycol, a quaternary ammonium salt or an amine; a dye forming coupler; a competing coupler; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color and black-and-white developers is generally 9 to 12. Although a quantity of replenisher of the developer depends on a color photographic light-sensitive material to be processed, it is generally 3 liters or less per $m^2$ of the photosensitive material. The quantity of replenisher can be decreased to be 500 ml or less by decreasing a bromide ion concentration in a replenisher. In order to decrease the quantity of replenisher, the contact area of a processing solution in a processing tank with air is preferably decreased to prevent evaporation and oxidation of the solution upon contact with air.

The area in which the photographic treating liquid contacts air in a treatment bath can be represented by an opening ratio which is obtained by dividing the liquid-air contact area ($cm^2$) by the volume ($cm^3$) of the treatment liquid. The opening ratio is preferably, 0.1 or less, more preferably 0.001 to 0.05. To reduce the opening ratio to a value falling within this range, a shield, such as a floating cover, can be placed on the surface of the treatment liquid in the bath. Another method is to use a movable cover of the type disclosed in JP-A-1-82033. Another alternative is the slit development disclosed in JP-A-62-216050. It is advisable to reduce the opening ratio, not only in the color development process and the black-and-white development process, but also in all other processes such as bleaching, bleach-fixing, fixing, water-washing, and stabilization.

The quantity of replenisher can be decreased by suppressing the accumulation of bromide ions in the developer.

A color development time is normally set between 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase the processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with applications. Examples of the bleaching agent are a compound of a multivalent metal such as iron (III); a peroxide; a quinone; and a nitro compound Typical examples of the bleaching agent include an organic complex salt of iron (III), e.g., a complex salt of an aminopolycarboxylic acid such as ethylenediaminetetraacetic acid, diethylenetriaminepentaacetic acid, cyclohexanediaminetetraacetic acid methyliminodiacetic acid, 1,3-diaminopropanetetraacetic acid, and glycoletherdiaminetetraacetic acid, or a complex salt of citric acid, tartaric acid or malic acid. Of these compounds, iron (III) complex salts of aminopolycarbosylic acid including iron (III) complex salts of ethylenediaminetetraacetic acid and 1,3-diaminopropanetetraacetic acid are preferred because they can increase a processing speed and prevent an environmental contamination. The iron (III) complex salt of aminopolycarboxylic acid is effective in both the bleaching and bleach-fixing solutions. The pH of the bleaching or bleach-fixing solution containing the iron (III) complex salt of aminopolycarboxylic acid is normally 4.0 to 8. In order to increase the processing speed, however, processing can be performed at a lower pH.

A bleaching accelerator can be used in the bleaching solution, the bleach-fixing solution and their prebath, if necessary. Examples of effective bleaching accelerators are compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and RD No. 17129 (July, 1978); thiazolidine derivatives described in JP-A-50-140129; thiourea derivatives described in JP-B-45-8506, JP-A-52-20832 and JP-A-53-32735, and U.S. Pat. No. 3,706,561; iodide salts described in West German Patent 1,127,715 and JP-A-58-16235; polyoxyethylene compounds described in West German Patents 966,410 and 2,748,430; a polyamine compound described in JP-B-45-8836; compounds described in JP-A-49-42434, JP-A-49-59644, JP-A-53-94927, JP-A-54-35727, JP-A-55-26506, and JP-A-58-163940; and a bromide ion. The compounds having a mercapto or disulfide group are preferred since they have a large accelerating effect. Of these, the compounds described in U.S. Pat. No. 3,893,858, West German Patent 1,290,812, and JP-A-53-95630 are particularly preferred. The compound described in U.S. Pat. No. 4,552,834 is also preferred. These bleaching accelerators may be added in the photosensitive material. These bleaching accelerators are effective especially in bleach-fixing of a colorphotosensitive material for picture taken with camera.

Preferably, the bleaching solution and the bleach-fixing solution contain, besides the compounds specified above, an organic acid for preventing bleaching stain.

Desirable as organic acid is a compound whose acid-dissociation constant (pKa) ranges from 2 to 5. More specifically, acetic acid and propionic acid are preferable.

Examples of the fixing agent which is contained in the fixing solution or the bleach-fixing solution are: a thiosulfate salt, a thiocyanate salt, a thioether compound, a thiourea, and a large amount of iodide. Of these compounds, a thiosulfate salt, especially ammonium thiosulfate, can be used in a widest range of application. It is also desirable that a thiosulfate salt be used in combination with a thiocyanate salt, a thioether compound, or a thiourea. As a preservative of the fixing solution or the bleach-fixing solution, a sulfite salt, a bisulfite salt, or a carbonyl bisulfite adduct, or a sulfinic acid compound disclosed in European Patent 294769A is preferred. Further, it is desirable that the fixing solution and the bleach-fixing solution contain aminopolycarboxylic acids or organic sulfonic acids, which stabilize the solution. The total time of desilvering should be as short as possible, but should be long enough to perform the desilverization sufficiently. The total desilvering time is preferably 1 to 2 minutes. It is advisable to perform the desilverization at a temperature ranging from 25° C. to 50° C., preferably 35° C. to 45° C. When performed at any temperature falling within this range, the desilvering will be accelerated, and stain generation will be effectively prevented.

It is recommendable that the stirring be performed as vigorously as possible in the desilvering step. To achieve vigorous stirring, a liquid jet can be applied to the emulsion surface of the photographic material as is disclosed in JP-A-62-183461, or the solution bath can be rotated as is taught in JP-A-62-183461. Another method of vigorously stirring the treating solution is to move the photographic material immersed in the bath, with its emulsion surface kept in contact with a wiper blade also immersed in the bath, causing a turbulent flow over the emulsion surface. Still another alternative is to increase the amount of the treating solution circulating within the bath, thereby intensifying the stirring.

Any of the stirring methods described above is efficient for the bleaching solution, the bleach-fixing solution, and the fixing solution. The vigorous stirring of the solution, thus accomplished, is believed to accelerate the supply of the bleaching agent or the fixing agent into the emulsion layer, thus increasing the desilvering speed. The methods can be effectively used in combination with the use of the bleaching accelerator, helping to accelerate the bleaching or preventing the bleaching accelerator from hindering the fixing.

The automatic developing machine which may be used for the color photographic photosensitive material of the the present invention should preferably have a transporting means of the type disclosed in JP-A-60-1911257, JP-A-60-191258, and JP-A-60-191259. If equipped with such a transporting means, the machine can greatly decrease the amount of the solution taken from the pre-bath to the after-bath, thereby maintaining the ability of the solution at a sufficiently high level. Since the solution preserves high ability, each photographing step can be completed within a short time, and the quantity of replenishing solution may be small.

The photographic photosensitive material of the present invention is normally subjected to washing and/or stabilizing steps after desilvering. An amount of water used in the washing step can be determined over a broad range in accordance with the properties of the photosensitive material (e.g., a property determined by the substances used such as couplers), the application of the material, the temperature of the washing water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248–253 (May, 1955).

According to the above-described multi-stage counter-current scheme, the amount of water used for washing can be greatly decreased. Since washing water stays in the tanks for a long period of time, however, bacteria multiply and the produced floating substances may be undesirably attached to the photosensitive material. In order to solve this problem in the process of the color photographic photosensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi, "Chemistry of Antibacterial and Antifungal Agents", 1986, published by Sankyo Shuppan, Eiseigijutsu-Kai ed., "Sterilization, Antibacterial, and Antifungal Techniques for Microorganisms", 1982, published by Kogyo Gijutsukai, and Nippon Bokin Bobabi Gakkai ed., "Dictionary of Antibacterial and Antifungal Agents", 1986.

The pH of the water for washing the photographic photosensitive material of the present invention is 4 to 9, and preferably, 5 to 8. The water temperature and the washing time can vary in accordance with the properties and applications of the photosensitive material. Normally, the washing time is 20 seconds to 10 minutes at a temperature of 15° C. to 45° C., and preferably, 30 seconds to 5 minutes at 25° C. to 40° C. The photosensitive material of the present invention can be processed directly by a stabilizer in place of washing. All known methods described in JP-A-57-8543, JP-A-58-14834, and JP-A-60-220345 can be used in such stabilizing process.

Stabilization is performed in some cases, after the water-washing. The stabilization is performed in a stabilizing bath containing, for example, a dye-stabilizing agent and a surface-active agent. This stabilizing bath is used as a final bath of the color photographic photosensitive material for use in taking pictures by a camera. Examples of the dye-stabilizing agent are aldehydes such as formalin and glutaraldehyde, N-methylol compounds, hexamethylenetetramine, or an aldehyde sulfite adduct.

Various cheleting agents or various antifungal agents can be added to the stabilizing bath.

An overflow solution produced upon washing and/or replenishment of the stabilizing solution can be used again in another step such as desilvering.

The treatment solutions described above may condense as the solvents evaporate while the solutions are being used in the automatic developing machine. If this is the case, it is preferred that water is added to the solutions, thereby adjusting the concentrations thereof.

The silver halide color photographic photosensitive material of the present invention may contain a color developing agent in order to simplify processing and increase a processing speed. In order to incorporate the color developing agent in the photosensitive material, various precursors of the color developing agent are preferably used. Examples of the precursor are an indoaniline-based compound described in U.S. Pat. No. 3,342,597; Schiff base compounds described in U.S. Pat. No. 3,342,599 and Research Disclosure Nos. 14,850 and 15,159; an aldol compound described in RD No. 13,924; a metal complex salt described in U.S. Pat. No. 3,719,492; and a urethane-based compound described in JP-A-53-135628.

The silver halide color photosensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution used in the present invention is used at a temperature of 10° C. to 50° C. Although a normal processing temperature is 33° C. to 38° C., processing may be accelerated at a high temperature to shorten a processing time, or image quality or stability of a processing solution may be improved at a lower temperature.

The color photographic photosensitive material of the invention can also be applied to thermal development photosensitive materials of the types described in U.S. Pat. No. 4,500,625, JP-A-60-133449, JP-A-59-218443, JP-A-61-238056, and European Patent 210,660A2.

If the photosensitive material according to the present invention is used in the form of a roll, it should better be contained in a cartridge. The cartridge, which is most popular at present is a 135-format patrone. Also, use can be made of the cartridges disclosed in JU-A-58-67329 and JU-A-58-195236 ("JU-A" means Published Unexamined Japanese Utility Model Application). Further, use can be made of the cartridges disclosed in JP-A-58-181035, JP-A-58-182634, U.S. Pat. Nos. 4,221,479, 4,846,418, 4,848,693, and 4,832,275, JP-A-1-231045, JP-A-2-124565, JP-A-2-170156, Japanese Patent Applications 1-231862, 1-25362, 1-30246, 1-20222, 1-21863, 1-37181, 1-33108, 1-85198, 1-172593, 1-172594 and 1-172595.

The present invention will be described in greater detail, with reference to the following examples. Nonetheless, the invention is not limited to these examples.

EXAMPLES

Layers having the compositions specified below were coated, one upon another, on undercoated, cellulose triacetate film supports, thereby preparing identical comparative samples 101 of a multi-layer color photosensitive material.

The coating amounts of silver halide and colloidal silver are represented in units of silver/m$^2$ and those of couplers, additives and gelatin are represented in units of g/m$^2$, those of sensitizing dyes are specified in terms of the number of mols per mol of silver halide in the layer. The additives will be identified by the following symbols; any additive which performs two or more functions, it is identified by the symbol representing its most prominent function.

UV: Ultraviolet-absorbing agent
Solv: High-boiling organic solvent
ExF: Dyestuff
ExS: Sensitizing dye
ExC Cyan coupler
ExM: Magenta coupler
ExY: Yellow coupler
Cpd: Additive

| Compositions of Layers | |
|---|---|
| Layer 1: Antihalation Layer | |
| Black Colloidal Silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| Layer 2: Low-Speed, Red-Sensitive Emulsion Layer | |
| Silver Iodobromide Emulsion (AgI = 4 mol %; tabular grains having sphere-equivalent diameter of 0.4 μm, variation coefficient in sphere-equivalent diameter of 37%, and diameter/thickness ratio of 3.0) | 0.4 |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-3 | 0.26 |
| Layer 3: Medium-Speed, Red-Sensitive Emulsion Layer | |
| Silver Iodobromide Emulsion (AgI = 6 mol %, tabular grains of internally high-AgI type, having core-shell ratio of 2:1, sphere-equivalent diameter of 0.65 μm, variation coefficient in sphere-equivalent diameter of 25%, and diameter/thickness ratio of 2.0) | 0.65 |
| Silver Iodobromide Emulsion (AgI = 4 mol %, tabular grains of homogeneous AgI type having sphere-equivalent diameter of 0.4 μm, variation coefficient in sphere-equivalent diameter of 37%, and diameter/thickness ratio of 3.0) | 0.1 |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-3 | 0.12 |
| Layer 4: High-Speed, Red-Sensitive Emulsion Layer | |
| Silver Iodobromide Emulsion (AgI = 6 mol %, tabular grains of internally high-AgI type, having core-shell ratio of 2:1, sphere-equivalent diameter of 0.7 μm, variation coefficient in sphere-equivalent diameter of 25%, and diameter/thickness ratio of 2.5) | 0.9 |
| Gelatin | 0.8 |
| ExS-1 | $1.6 \times 10^{-4}$ |
| ExS-2 | $1.0 \times 10^{-4}$ |
| ExS-5 | $1.6 \times 10^{-4}$ |
| ExS-7 | $5.6 \times 10^{-6}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |
| Layer 5: Interlayer | |
| Gelatin | 0.6 |
| UV-4 | 0.03 |
| UV-5 | 0.04 |
| Cpd-1 | 0.1 |
| Polyethylacrylate Latex | 0.08 |
| Solv-1 | 0.05 |
| Layer 6: Low-Speed, Green-Sensitive Emulsion Layer | |

-continued

| Compositions of Layers | |
|---|---|
| Silver Iodobromide Emulsion (AgI = 4 mol %, tabular grains of homogeneous AgI type having sphere-equivalent diameter of 0.4 μm, variation coefficient in sphere-equivalent diameter of 37%, and diameter/thickness ratio of 2.0) | 0.18 |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |
| Layer 7: Medium-Speed, Green-Sensitive Emulsion Layer | |
| (Silver Iodobromide Emulsion AgI = 4 mol %, tabular grains of surface high-AgI type, having core-shell ratio of 1:1, sphere-equivalent diameter of 0.5 μm, variation coefficient in sphere-equivalent diameter of 25%, and diameter/thickness ratio of 4.0) | 0.27 |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| Layer 8: High-Speed, Green-Sensitive Emulsion Layer | |
| Silver Iodobromide Emulsion (AgI = 8.7 mol %, tabular grains of multi-layered type of silver content ratio of 3:4:2, AgI contents 24 mol %, 0 mol % and 3 mol %, from the core, having sphere-equivalent diameter of 0.7 μm, variation coefficient in sphere-equivalent diameter of 25%, and diameter/thickness ratio of 1.6) | 0.7 |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-1 | 0.01 |
| Solv-1 | 0.25 |
| Solv-2 | 0.06 |
| Solv-4 | 0.01 |
| Cpd-7 | $1 \times 10^{-4}$ |
| Layer 9: Interlayer | |
| Gelatin | 0.6 |
| Cpd-1 | 0.04 |
| Polyethylacrylate Latex | 0.12 |
| Solv-1 | 0.02 |
| Layer 10: Donor Layer of Interlayer Effect for Red-Sensitive Layers | |
| Silver Iodobromide Emulsion (AgI = 6 mol %, monodispersed tabular grains of internally high-AgI type, having core-shell ratio of 2:1, sphere-equivalent diameter of 0.7 μm, variation coefficient in sphere-equivalent diameter of 18%, and diameter/thickness ratio of 2.0) | 0.68 |
| Silver Iodobromide Emulsion (AgI = 4 mol %, tabular grains of homogeneous AgI type having sphere-equivalent diameter of 0.3 μm, variation coefficient in sphere-equivalent diameter of 37%, and diameter/thickness ratio of 3.0) | 0.19 |
| Gelatin | 1.0 |
| ExS-3 | $6 \times 10^{-4}$ |
| ExM-10 | 0.19 |
| Solv-1 | 0.20 |
| Layer 11: Yellow Filter Layer | |
| Yellow Colloidal Silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| Layer 12: Low-Speed, Blue-Sensitive Emulsion Layer | |
| Silver Iodobromide Emulsion (AgI = 4.5 mol %, tabular grains of homogeneous AgI type having sphere-equivalent diameter of 0.7 μm, variation coefficient in sphere-equivalent diameter of 25%, and diameter/thickness ratio of 7.0) | 0.3 |
| Silver Iodobromide Emulsion (AgI = 3 mol %, tabular grains of homogeneous AgI type having sphere-equivalent diameter of 0.3 μm, variation coefficient in sphere-equivalent diameter of 30%, and diameter/thickness ratio of 7.0) | 0.15 |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| Layer 13: Interlayer | |
| Gelatin | 0.7 |
| ExY-12 | 0.20 |
| Solv-1 | 0.34 |
| Layer 14: High-Speed, Blue-Sensitive Emulsion Layer | |
| Silver Iodobromide Emulsion (AgI = 10 mol %, tabular grains of internally high-AgI type and multi-twinned crystal type, having sphere-equivalent diameter of 1.0 μm, variation coefficient in sphere-equivalent diameter of 25%, and diameter/thickness ratio of 2.0) | 0.5 |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| Layer 15: First Protective Layer | |
| Fine Grain Silver Iodide Emulsion (AgI = 2 mol %, homogeneous AgI type having sphere-equivalent diameter of 0.07 μm) | 0.12 |
| Gelatin | 0.9 |
| UV-4 | 0.11 |
| UV-5 | 0.16 |
| Solv-5 | 0.02 |
| H-1 | 0.13 |
| Cpd-5 | 0.1 |
| Polyethylacrylate Latex | 0.09 |
| Layer 16: Second Protective Layer | |
| Fine Grain Silver Iodide Emulsion (AgI = 2 mol %, homogeneous AgI type having sphere-equivalent | 0.36 |

-continued
| Compositions of Layers | |
|---|---|
| diameter of 0.07 μm) | |
| Gelatin | 0.55 |
| Polymethylacrylate Grains (Diameter: 1.56 μm) | 0.2 |
-continued
| Compositions of Layers | |
|---|---|
| H-1 | 0.17 |
Each of the layers specified above further contained stabilizing agent Cpd-3 (0.07 g/m$^2$) and surface active agent Cpd-4 (0.03 g/m$^2$), both used as coating aids.
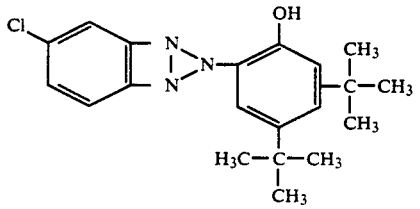
UV-1
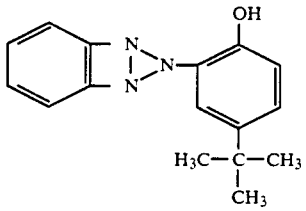
UV-2
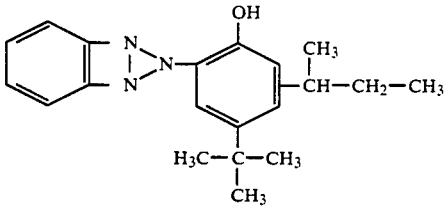
UV-3
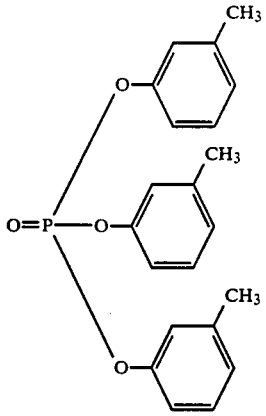
Solv-1
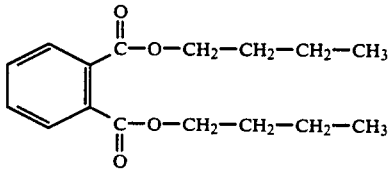
Solv-2

-continued
Solv-4
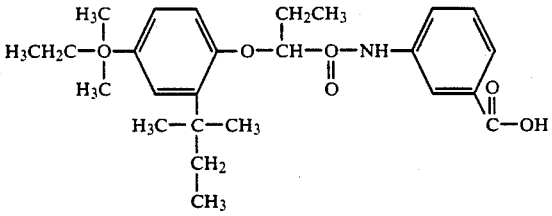
Solv-5
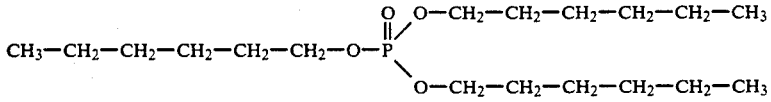
ExF-1
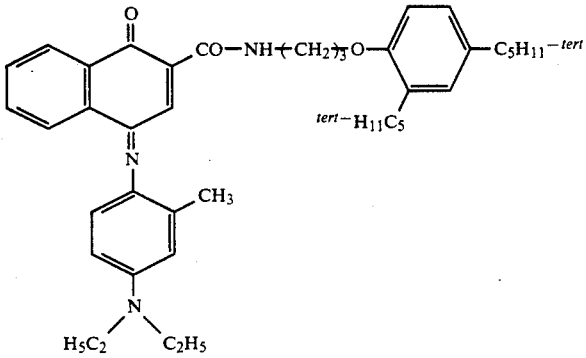
UV-4
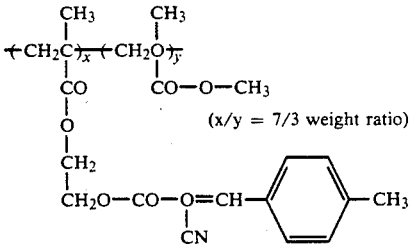
(x/y = 7/3 weight ratio)
UV-5
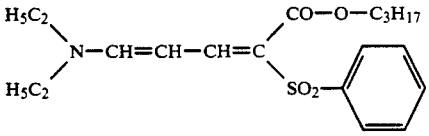
ExF-2
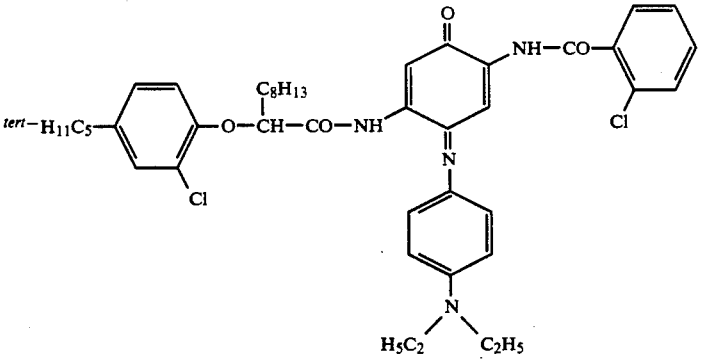
ExS-1
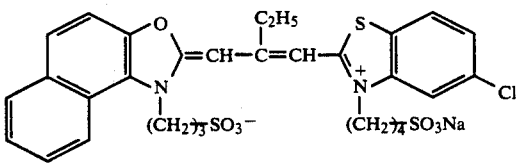

-continued
ExS-2
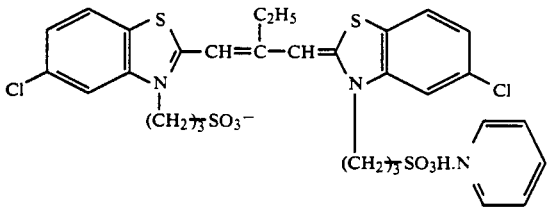
ExS-3
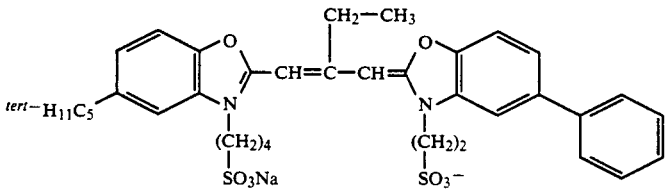
ExS-4
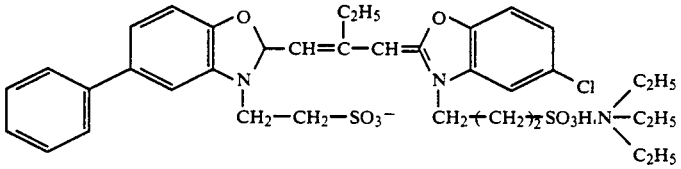
ExS-5
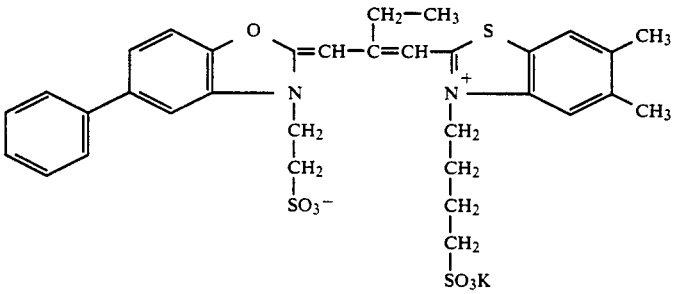
ExS-6
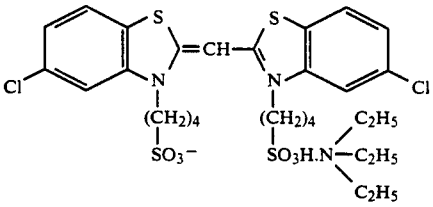
ExS-7
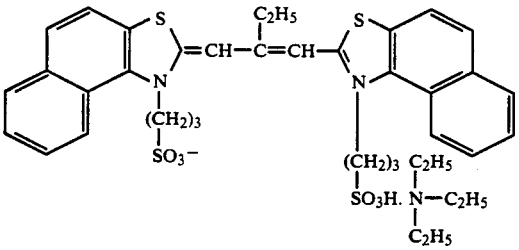
ExS-8
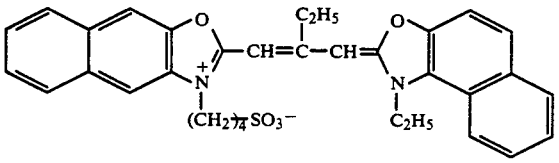

-continued
ExC-1
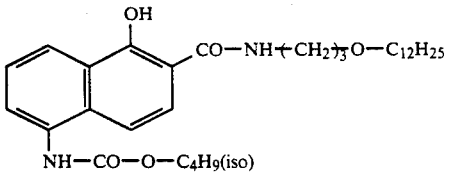
ExC-2
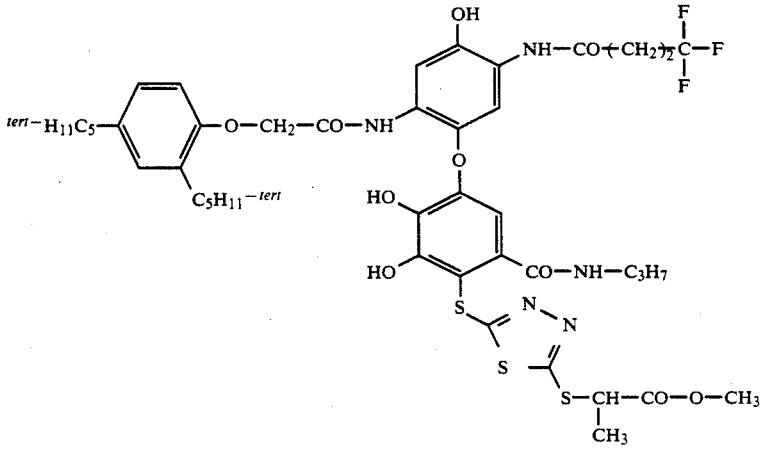
ExC-3
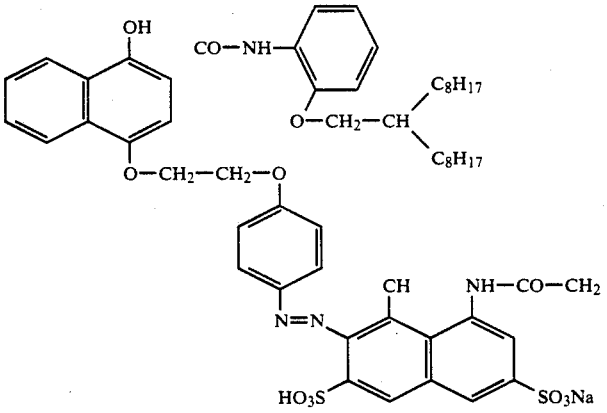
ExC-4
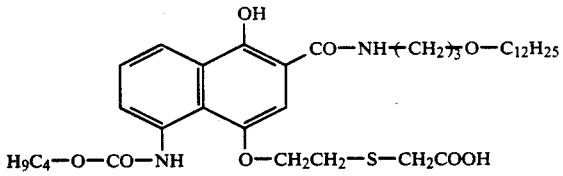
ExM-5
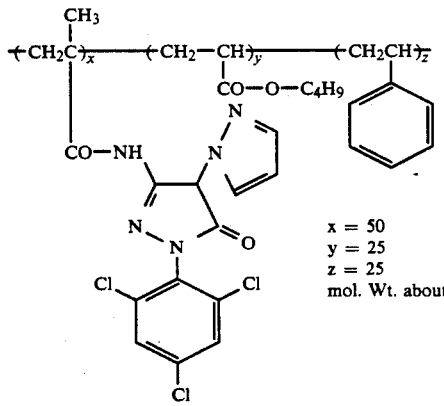
x = 50
y = 25
z = 25
mol. Wt. about 20000

-continued
ExM-6
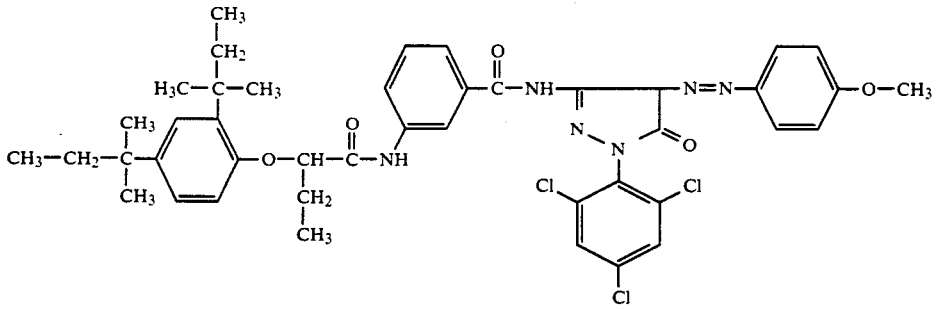
ExM-7
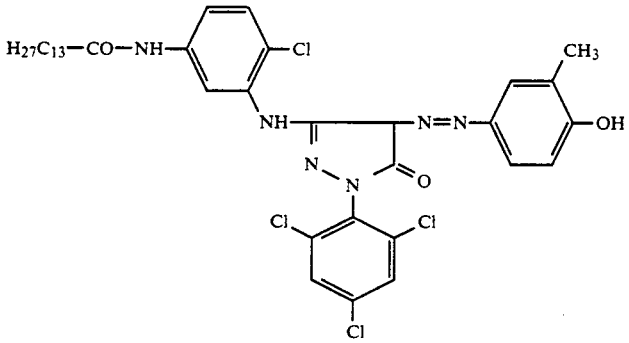
ExM-10
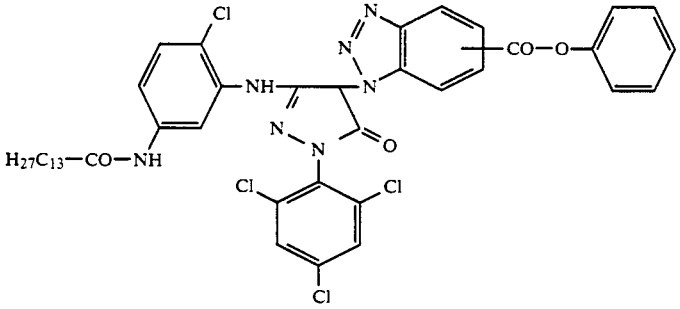
ExY-8
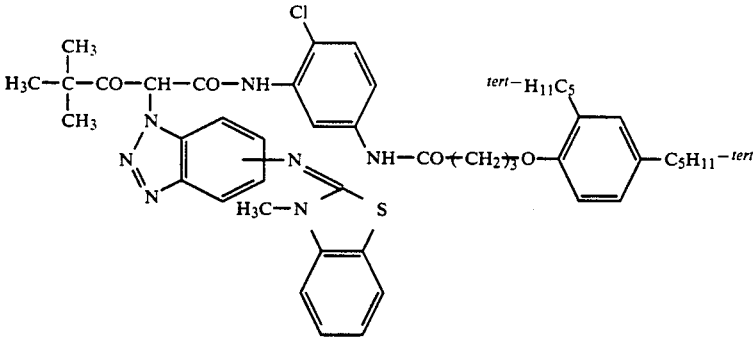
ExY-9
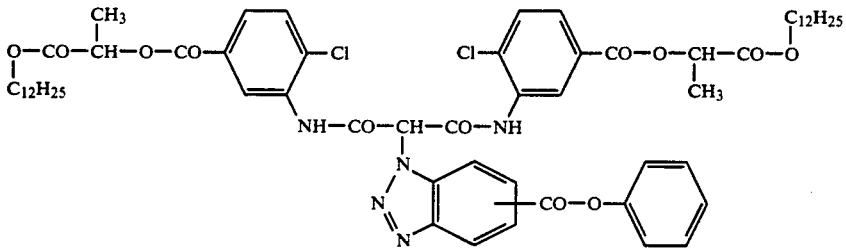

-continued
ExY-11
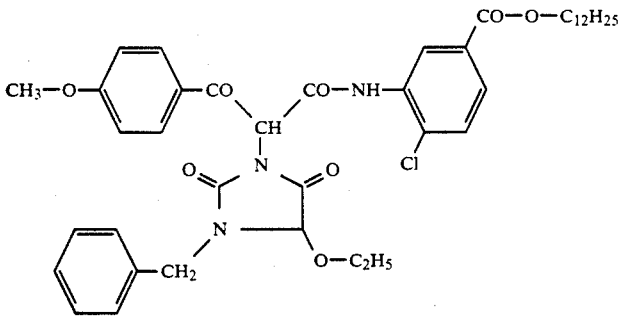
ExY-12
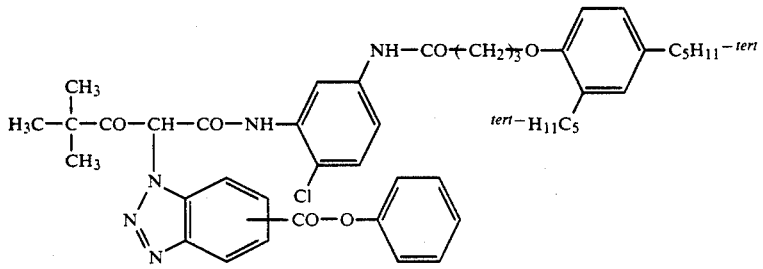
Cpd-7
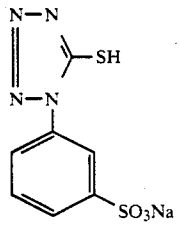
Cpd-1
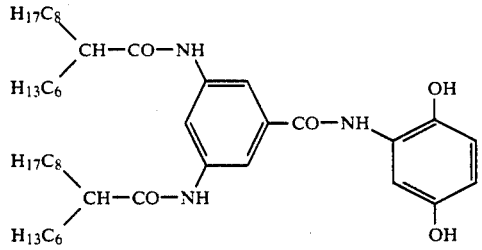
Cpd-2
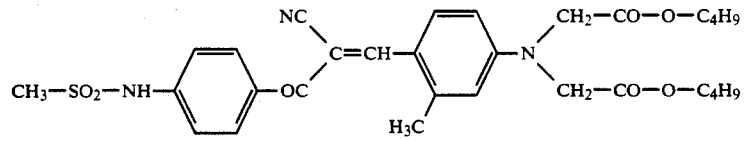
Cpd-6
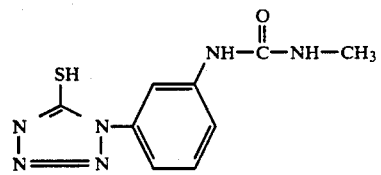
H-1
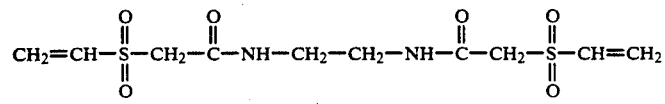
Cpd-5
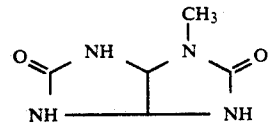

-continued

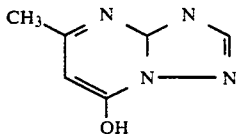

Cpd-3

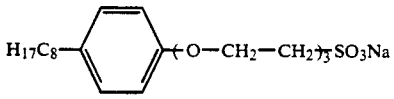

Cpd-4

Samples 101 were modified in various manners, as will be specified below, thereby preparing samples 102 to 107.

Sample 102 (The Invention)

ExC-2 was added to Layer 2, in an amount of 0.03 g/m$^2$, and ExC-3 was used in Layer 2 in an amount of 0.13 g/m$^2$, instead of 0.26 g/m$^2$ Further, ExC-2 was added to Layer 3, in an amount of 0.01 g/m$^2$, and ExC-3 was used in an amount of 0.06 g/m$^2$, instead of 0.12 g/m$^2$.

Sample 103 (Comparative Example)

Layers 2, 3 and 4 of sample 101 were modified by changing the amounts of the additives, as follows:

a. Layer 2
ExS-1: Changed from $2.3\times10^{-4}$ to $0.5\times10^{-4}$
ExS-2: Changed from $1.4\times10^{-4}$ to $3.0\times10^{-4}$
ExS-5: Changed from $2.3\times10^{-4}$ to $0.5\times10^{-4}$
ExS-7: Changed from $8.0\times10^{-6}$ to $1.6\times10^{-5}$
b. Layer 3
ExS-1: Changed from $2\times10^{-4}$ to $0.4\times10^{-4}$
ExS-2: Changed from $1.2\times10^{-4}$ to $2.6\times10^{-4}$
ExS-5: Changed from $2\times10^{-4}$ to $0.4\times10^{-4}$
ExS-7: Changed from $7\times10^{-6}$ to $1.4\times10^{-5}$
c. Layer 4
ExS-1: Changed from $1.6\times10^{-4}$ to $0.3\times10^{-4}$
ExS-2: Changed from $1.0\times10^{-4}$ to $2.1\times10^{-4}$
ExS-5: Changed from $1.6\times10^{-4}$ to $0.3\times10^{-4}$
ExS-7: Changed from $5.6\times10^{-6}$ to $1.1\times10^{-5}$ Sample 104 (Comparative Example)

Layers 2, 3 and 4 of sample 101 were modified by changing the amounts of the additives, as follows:

a. Layer 2
ExS-1: Changed from $2.3\times10^{-4}$ to 0
ExS-2: Changed from $1.4\times10^{-4}$ to $3.0\times10^{-4}$
ExS-5: Changed from $2.3\times10^{-4}$ to 0
ExS-7: Changed from $8.0\times10^{-6}$ to $1.6\times10^{-5}$
b. Layer 3
ExS-1: Changed from $2\times10^{-4}$ to 0
ExS-2 Changed from $1.2\times10^{-4}$ to $2.6\times10^{-4}$
ExS-5: Changed from $2\times10^{-4}$ to 0
ExS-7: Changed from $7\times10^{-6}$ to $1.4\times10^{-5}$
c. Layer 4
ExS-1: Changed from $1.6\times10^{-4}$ to 0
ExS-2: Changed from $1.0\times10^{-4}$ to $2.1\times10^{-4}$
ExS-5: Changed from $1.6\times10^{-4}$ to $0.3\times10^{-4}$
ExS-7: Changed from $5.6\times10^{-6}$ to $1.1\times10^{-5}$ Sample 105 (The Invention)

Layers 2, 3 and 4 of sample 101 were modified by changing the amounts of the additives, as follows:

a. Layer 2
ExS-1: Changed from $2.3\times10^{-4}$ to $3.5\times10^{-4}$
ExS-2: Changed from $1.4\times10^{-4}$ to $0.7\times10^{-4}$
ExS-5: Changed from $2.3\times10^{-4}$ to $3.5\times10^{-4}$
ExS-7: Changed from $8.0\times10^{-6}$ to 0
b. Layer 3
ExS-1: Changed from $2\times10^{-4}$ to $3.0\times10^{-4}$
ExS-2: Changed from $1.2\times10^{-4}$ to $0.6\times10^{-4}$
ExS-5: Changed from $2\times10^{-4}$ to $3.0\times10^{-4}$
ExS-7: Changed from $7\times10^{-6}$ to 0
c. Layer 4
ExS-1: Changed from $1.6\times10^{-4}$ to $2.0\times10^{-4}$
ExS-2: Changed from $1.0\times10^{-4}$ to $0.5\times10^{-4}$
ExS-5: Changed from $1.6\times10^{-4}$ to $2.0\times10^{-4}$
ExS-7: Changed from $5.6\times10^{-6}$ to 0

Sample 106 (Comparative Example)

Layers 2 and 3 of sample 101 were modified as follows:

a. Layer 2
ExC-2: Added in an amount of 0.05 g/m$^2$
ExC-3: Changed from 0.26 to 0.07
b. Layer 3
ExC-2: Added in an amount of 0.15 g/m$^2$
ExC-3: Changed from 0.12 to 0.03

Sample 107 (Comparative Example)

Layers 2 and 3 of sample 101 were modified as follows:

a. Layer 2
ExC-2: Added in an amount of 0.07 g/m$^2$
ExC-3: Changed from 0.26 to 0
b. Layer 3
ExC-2: Added in amount of 0.02
ExC-3: Changed from 0.12 to 0

Samples 101 to 107, thus prepared, were subjected to wedge exposure by using white light (C light source), and then to development which will be described later. Further, the densities of the samples, thus developed, were measured by means of the density detector (i.e., a status M filter) manufactured by Macbeth Co., Ltd. Samples 101 to 107 exhibited very similar sensitometry curves, indicating that the samples had almost identical sensitivity gradations for all color-filter densities, except green-filter density.

Using the seven samples, a red rose with leaves were photographed under the same conditions. The samples were so processed, that images of the rose were printed from the processed samples onto Fuji-Color Paper Super HG (tradename) such that the prints had gray background of the same density. Five experts evaluated the hue of red-petal image and that of green-leaf image on each print. Each expert gave two points to an excellent red-petal image, one point to a good red-petal image, and no points to a poor red-petal image; he or she gave two points to an excellent green-leaf image, one point to a good green-leaf image, and no points to a poor green-leaf image. The total points the five experts gave to the red-petal and green-leaf images of each print were divided by 5, thereby evaluating each sample of the color photographic photosensitive material. The results were as is shown in Table 1.

| Processing Method | | | | |
|---|---|---|---|---|
| Process | Time | Temp. | Quantity of Replenisher* | Tank Volume |
| Color Development | 3 min. 15 sec. | 38° C. | 16 ml | 10 l |
| Bleaching | 40 sec. | 38° C. | 5 ml | 4 l |
| Fixing 1 | 40 sec. | 38° C. | — | 4 l |
| Fixing 2 | 40 sec. | 38° C. | 30 ml | 4 l |
| Washing 1 | 30 sec. | 38° C. | — | 2 l |
| Washing 2 | 30 sec. | 38° C. | 30 ml | 2 l |
| Stabilization | 30 sec. | 38° C. | 20 ml | 2 l |
| Drying | 1 min. | 55° C. | — | — |

*Quantity per meter of a 35 mm wide sample

The compositions of the process solutions used were as follows:

| | Mother Solution | Replenisher |
|---|---|---|
| Color Developing Solution | | |
| Diethylenetriamine-pentaacetic acid | 1.0 g | 1.1 g |
| 1-hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | — |
| Potassium Iodide | 1.5 mg | — |
| Additive | $30 \times 10^{-2}$ mol | $4.4 \times 10^{-2}$ mol |
| 4-(N-ethyl-N-β-hydroxyethylamino)-2-methylalinine Sulfate | 4.5 g | 8.0 g |
| Water to make | 1.0 l | 1.0 l |
| pH | 10.05 g | 10.20 g |
| Bleaching Solution | | |
| Ferric Ammoniuma 1,3-Diaminopropne-tetraacetate (1,3-DPTA Fe (III)) | 144.0 g | 206.0 g |
| 1,3-Diaminopropane Tetraacetic Acid | 2.8 g | 4.0 g |
| Ammonium Bromide | 84.0 g | 120.0 g |
| Ammonium Nitrate | 90.0 g | 125.0 g |
| Hydroxyacetic Acid (71%) | 93.6 g | 130.0 g |
| Water to make | 1.0 l | 1.0 l |
| pH (adjusted by 27%-ammonia water) | 4.0 | 3.2 |
| Fixing Solution | | |
| 1,3-Diaminopropane Tetraacetic Acid | 4.5 g | 22.5 g |
| Imidazole | 30.0 g | 33.0 g |
| Ammonium Sulfite | 12.0 g 20.0 g | |
| Ammonium Thiosulfate Aqueous Solution (70%) | 290 ml | 320 ml |
| Ammonia Water (27%) | 6 ml | 15 ml |
| Water to make | 1.0 l | 1.0 l |
| pH | 6.8 | 8.0 |

Washing Water: Common for mother solution and replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IRA-400) to set concentrations of calcium and magnesium ion to be 3 mg/l or less. Subsequently, 20 mg/l of sodium isocyanuric acid dichloride and 150 mg/l of sodium sulfate were added. The pH of the water fell within the range of 6.5 to 7.5.

| Stabilizing Solution: | Common for mother solution and Replenisher |
|---|---|
| Formalin (37%) | 2.0 ml |
| Polyoxyehtylene-p-mononononylphenylether | 0.3 g |

-continued

| | Mother Solution | Replenisher |
|---|---|---|
| (average polymerization degree = 10) | | |
| Disodium Ethylene-diaminetetraacetate | 0.05 g | |
| Water to make | 1.0 l | |
| pH | 5.0–8.0 | |

TABLE 1

| Sample | $S_{650}$/Smax × 100 (%) | Gradation by Green Filter in Red-Sensitive Layer | Reproduced Hue of Red Petals | Reproduced Hue of Green Leaves |
|---|---|---|---|---|
| 101 Comparative Example | 45 | 0.03 | 1.4 | 0.8 |
| 102 Invention | 45 | 0.07 | 1.5 | 1.7 |
| 103 Comparative Example | 55 | 0.07 | 0.7 | 1.6 |
| 104 Comparative Example | 90 | 0.07 | 0.3 | 1.5 |
| 105 Invention | 30 | 0.10 | 1.8 | 1.9 |
| 106 Comparative Example | 45 | 0.00 | 1.3 | 0.7 |
| 107 Comparative Example | 45 | −0.03 | 1.2 | 0.3 |

As is evident from Table 1, the hues of the red petals and green leaves reproduced by samples 102 and 105, both of the present invention, were evaluated at a value over the average of 1.0. This means that the five experts recognized that samples 102 and 105 had excellent color reproducibility, and hence the advantages of the present invention.

What is claimed is:

1. A silver halide color negative photographic photosensitive film material, comprising:

a support; and a layer arrangement formed on said support and comprising:

a red-sensitive silver halide emulsion layer containing a color coupler capable of forming cyan dye upon reacting with an oxidation product of a developing agent, a green-sensitive silver halide emulsion layer containing a color coupler capable of forming magenta dye upon reacting with the oxidation product of the developing agent, and a blue-sensitive silver halide emulsion layer containing a color coupler capable of forming yellow dye upon reacting with the oxidation product of the developing agent;

said red-sensitive layer having a sensitivity at 650 nm of 50% or less of its maximum sensitivity, and containing substantially no magenta-colored cyan couplers;

said color negative film further comprising a development inhibitor releasing coupler.

2. The color negative film according to claim 1, wherein the sensitivity at 650 nm of the red-sensitive emulsion layer is 30% or less of its maximum sensitivity.

3. The color negative film according to claim 1, wherein the red-sensitive emulsion layer provides under-masking to the green-sensitive layer when it is exposed singly.

4. The color negative film according to claim 1, wherein a gradient of the negative image is 0.05 or more.

5. The color negative film according to claim 1, wherein the development inhibitor releasing coupler includes at least one coupler selected from the group consisting of the following formulas:

$$A\text{-}TIME\text{-}Z_2 \quad (VI)$$

$$A\text{-}Z_1 \quad (VII)$$

$$A\text{-}P\text{-}Z_2 \quad (IX)$$

wherein A is a coupling component which can react with the oxidation product of the color developing agent to release a -TIME-$Z_2$ group or a -P-$Z_2$ group, TIME is a timing group, $Z_1$ is a diffusible development inhibitor, -P-$Z_2$ is a group which, after being released from A, generates a development inhibitor upon reacting with the oxidation product of the developing agent, $Z_2$ is a diffusible development inhibitor, A-TIME-$Z_2$ is a diffusible DIR compound if -TIME-$Z_2$ is diffusible, A-P-$Z_2$ is a diffusible DIR compound if -P-$Z_2$ is diffusible.

6. The color negative film according to claim 5, wherein A is selected from the group consisting of acylacetoanilides, malondiesters, malondiamides, benzoylmethanes, pyrazolones, pyrazotriazoles, pyrazobenzimidazoles, indazolones, phenols, naphthols, acetophenones, indanones, and oxazolones.

7. The color negative film according to claim 5, wherein A is represented by formulas (X) to (XIII):

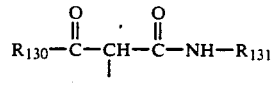
Formula [X]

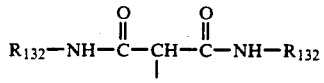
Formula [XI]

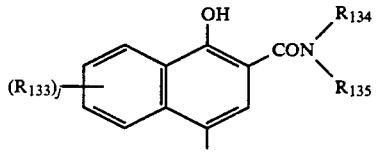
Formula [XII]

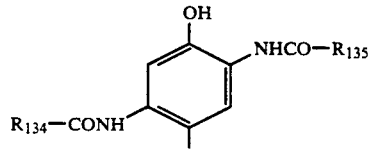
Formula [XIII]

wherein $R_{130}$ is an aliphatic group, an aromatic group, an alkoxy group, or a heterocyclic group, $R_{131}$ and $R_{132}$ are either an aromatic group or a heterocyclic group, $R_{133}$ is a hydrogen atom, an alkyl group, a halogen atom,, a carboamide group, or a sulfonamide group, j is an integer from 1 to 5, $R_{134}$ and $R_{135}$ are hydrogen atoms, alkyl groups, or aryl groups.

8. The color negative film according to claim 5, wherein the development inhibitor is represented by formula (IX) and P is a group which becomes a redox group or a coupler after it has been cleaved from A.

9. The color negative film according to claim 5, wherein any of the compounds (VI), (VII) or (IX) are contained in any layer of the color negative film material in an amount in the range of 0.0001 to 0.1 mol per mol of silver if that layer contains a silver halide emulsion, or, if the layer contains no silver halide emulsions, the compounds of formulas (VI), (VII) or (IX) can be contained in the layer in an amount falling within said range per mol of silver which is contained in a layer adjacent to that layer.

10. The color negative film according to claim 1, wherein at least one sublayer of the red-sensitive layer or a layer adjacent thereto contains a development inhibitor releasing coupler.

* * * * *